US006252183B1

(12) United States Patent
Shirai

(10) Patent No.: US 6,252,183 B1
(45) Date of Patent: Jun. 26, 2001

(54) SEAT SWITCH ASSEMBLY INCLUDING A MULTIPLE POSITION ADJUSTMENT MECHANISM

(75) Inventor: Shinji Shirai, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/380,461

(22) PCT Filed: Mar. 9, 1998

(86) PCT No.: PCT/JP98/00961

§ 371 Date: Nov. 23, 1999

§ 102(e) Date: Nov. 23, 1999

(87) PCT Pub. No.: WO98/39786

PCT Pub. Date: Sep. 11, 1998

(30) Foreign Application Priority Data

Mar. 7, 1997 (JP) ..... 9-53391

(51) Int. Cl.[7] ..... H01H 9/26; H01H 25/00; H01H 25/06

(52) U.S. Cl. ..... 200/5 R; 200/18; 200/50.32

(58) Field of Search ..... 200/1 R, 5 R, 200/17 R, 18, 1 B, 5 B–5 D, 50.32–50.4

(56) References Cited

U.S. PATENT DOCUMENTS

| | | | | |
|---|---|---|---|---|
| 4,695,682 | | 9/1987 | Winogrocki | 200/5 R |
| 5,021,614 | * | 6/1991 | Sasaki et al. | 200/5 R |
| 5,128,500 | * | 7/1992 | Hirschfeld | 200/5 R |
| 5,130,501 | * | 7/1992 | Maeda | 200/5 B |
| 5,243,156 | * | 9/1993 | Shirasaka | 200/5 R |
| 5,278,363 | | 1/1994 | Krieg et al. | 200/5 R |
| 5,384,440 | * | 1/1995 | Wnuk et al. | 200/5 R |
| 5,442,149 | | 8/1995 | Sato | 200/5 R |

FOREIGN PATENT DOCUMENTS

| | | |
|---|---|---|
| 0 124 751 A2 | 11/1984 | (EP) . |
| 0 530 509 A2 | 3/1993 | (EP) . |
| 4-10940 | 1/1992 | (JP) . |
| 7-312147 | 11/1995 | (JP) . |

* cited by examiner

*Primary Examiner*—J. R. Scott
(74) *Attorney, Agent, or Firm*—Morgan, Lewis & Bockius LLP

(57) ABSTRACT

A seat switch for adjusting a power seat includes a case main body having a first switch, a seat slide switch and a second switch arranged in the case main body. The seat switch also includes a first and third operational members pivotally connected to the case main body that selectively engage first and third switches, respectively, when operated in a first direction. A second operational member is pivotally connected to the case main body and selectively engages the seat slide switch when operated in a second direction, which is substantially perpendicular to the first direction. Each operational member is able to independently pivot with respect to another operational member. A restriction member is disposed in the case main body that restricts movement of the second operational member when first and third operational members are operated in the first direction, and restricts movement of the first and third operational members when the second operational member is operated in the second direction. The seat switch further includes a knob member having first and third engaging portions selectively engaging the first and third operational members respectively, and a second engaging portion selectively engaging the second operational member. The first and third engaging portions engage first and third operational members, and the second engaging portion freely slides over the second operational member, when operated in the first direction. The second engaging portion engages the second operational member, and the first and third engaging portions freely slide over the first and third operational members, when operated in the second direction.

20 Claims, 10 Drawing Sheets

SEAT SWITCH ASSEMBLY INCLUDING A MULTIPLE POSITION ADJUSTMENT MECHANISM

BACKGROUND OF THE INVENTION

1. Field of the Invention

The present invention relates to a seat switch for use in a power seat.

2. Description of the Related Prior Art

As a conventional seat switch for a power seat provided in a vehicle, there is known a seat switch of a type which is shown in FIG. 16 (*a*). FIG. 16 (*a*) shows a switch knob 1 which is disposed in each of the two side portions of a vehicle power seat. Also, in FIG. 16 (*a*), reference characters 2, 3 and 4 respectively designate the operation positions of a front seat vertical switch operation shaft, a seat slide switch operation shaft, and a rear seat vertical switch operation shaft. In FIGS. 16 (*a*) to (*c*) and in FIGS. 15 (*a*) and (*b*), the left side thereof is assumed to be the front side of the vehicle, while the right side thereof is assumed to be the rear side of the vehicle.

If the switch knob 1 shown in FIG. 16 (*a*) is operated in a direction of an arrow line A (in the back-and-forth direction thereof) shown in FIG. 16 (*a*), then the seat slide switch operation shaft 3 is operated by the switch know 1, with the result that, as shown in FIG. 16 (*c*), the power seat 5 is driven by a drive motor (not shown) and is thereby moved in the back-and-forth direction thereof (in a direction of an arrow line a which is shown in FIG. 16 (*c*)).

Also, as shown in FIG. 16 (*a*), if the front side of the switch knob 1 is swung in the vertical direction (in a direction of an arrow line B shown in FIG. 16 (*a*), then the front seat vertical switch operation shaft 2 is operated on by the switch knob 1, with the result that, as shown in FIG. 16 (*c*), the front seat surface of the power seat 5 is driven by a drive motor (not shown) and is thereby moved up or down in a direction of an arrow line b shown in FIG. 16 (*c*). Also, as shown in FIG. 16 (*a*), if the rear side of the switch knob 1 is swung in the vertical direction (in a direction of an arrow line C shown in FIG. 16 (*a*), then the rear seat vertical switch operation shaft 4 is operated on by the switch knob 1, with the result that, as shown in FIG. 16 (*c*), the rear seat surface of the power seat 5 is driven due to the driving force of a drive motor (not shown) and is thereby moved up or moved down in a direction of an arrow line c shown in FIG. 16 (*c*).

As described above, in the conventional structure, the operation directions of the switch knob 1 shown in FIG. 16 (*a*) are made to correspond to the operation directions of the power seat 5. And, since the switch knob of this type is capable of moving up and down the power seat 5 respectively in the front and rear seat surfaces thereof, the present switch knob is generally referred to as a switch knob of a seat vertical 4-way type.

On the other hand, as another conventional switch knob, there is known a switch knob 6 of a type which is shown in FIG. 16 (*b*). In FIG. 16 (*b*), reference character 7 designates the position of the fixed shaft of the switch knob 6, while 2 and 3 respectively stand for the positions of the same operation shafts as in the above-mentioned conventional switch knob 1.

If the switch knob 6 shown in FIG. 16 (*b*) is operated in a direction of an arrow line A (in the back-and-forth direction thereof) shown in FIG. 16 (*b*), then the seat slide switch operation shaft 3 is operated by the switch knob 6, with the result that, as shown in FIG. 16 (*c*), the power seat 5 is moved in the back-and-forth direction thereof (in the arrow line a direction shown in FIG. 16 (*c*) due to the driving force of a drive motor (not shown).

Also, as shown in FIG. 16 (*b*), if the front side of the switch knob 6 is swung in the vertical direction (in a direction of an arrow line B shown in FIG. 16 (*b*)), then the switch knob 6 is swung about the fixed shaft 7, with the result that, as shown in FIG. 16 (*c*), the front seat surface of the power seat 5 is moved up or down in the vertical direction (in the arrow line c direction shown in FIG. 16 (*c*)) due to the driving force of a drive motor (not shown). Since the switch knob 6 of this type is capable of moving up or down the power seat 5 only in one of the seat surfaces of the two end portions of the power seat (in this case, the seat surface of the front portion of the power seat) thereof, the switch knob is generally referred to as a switch knob of a seat vertical 2-way type.

Further, as an example of a switch knob of a seat vertical 2-way type, there is known a switch knob which is shown in FIG. 15 (*a*). In this example, if a switch knob 8 shown in FIG. 15 (*a*) is operated in a direction of an arrow line A shown in FIG. 15 (*a*) (that is, in the back-and-forth direction thereof), then a seat slide switch operation shaft 3 is operated on by the switch knob 8, with the result that, as shown in FIG. 16 (*c*), the power seat 5 is moved in the back-and-forth direction thereof (in the arrow line a direction shown in FIG. 16 (*c*) due to the driving force of a drive motor (not shown). Also, as shown in FIG. 15 (*a*), if the rear side of the switch knob 8 is swung in a direction of an arrow a line C shown in FIG. 15 (*a*), then the switch knob 8 is swung about a fixed shaft 7*a* and a rear seat vertical operation shaft 4 is thereby operated on, with the result that, as shown in FIG. 16 (*c*), the rear portion seat surface of the power seat 5 is moved up or down in the arrow line c direction shown in FIG. 16 (*c*) due to the driving force of a drive motor (not shown).

As described above, the switch knobs 1, 6 and 8 are all structured such that the portions of the switch knobs 1, 6 and 8 to be operated are respectively allowed to correspond to the portions of the power seat 5 to be operated, while the operation directions of the portions of the switch knobs 1, 6 and 8 to be operated are respectively allowed to correspond to the operation directions of the power seat 5. The reason why the motion of the power seat and the motion of the switch knobs are allowed to correspond to each other is that, when an operator wants to move up or down a given portion of the power seat, if the operator operates the operation portion of the switch knob that is allowed to correspond to the given portion of the power seat, then the given portion of the power seat can be operated easily with no trouble.

Although the seat vertical movement adjusts the seat front portion surface or seat rear portion surface of the power seat 5 by the above-mentioned conventional switch knob, as shown in FIG. 15 (*b*), there exists a need to move up or down the whole seat surface of the power seat 5 in a direction of an arrow line d shown in FIG. 15 (*b*) (that is, in the vertical direction thereof). In this case as well, the motion of the power seat 5 requires using a switch knob of a seat vertical 2-way type and the operation of the switch knob must be executed in correspondence to the motion of the power seat 5 for the above-mentioned reason.

However, in the conventional switch knobs 6 and 8 of a seat vertical 2-way type, there arises a problem that the movements of the switch knobs 6 and 8 cannot be made to correspond to the motion of the power seat 5 shown in FIG. 15 (*b*). That is, in the switch knob 6 shown in FIG. 16 (*b*), the front portion of the switch knob 6 is operated in the arrow line B direction and, in the switch knob 8 shown in FIG. 15 (*a*), the rear portion of the switch knob 8 is operated in the arrow line C direction: and, therefore, the movements of the switch knobs 6 and 8 are different from the motion of the power seat 5 shown in FIG. 15 (*b*).

Also, when trying to dispose a switch knob in such a manner that the motion thereof is allowed to correspond to the motion of the power seat 5 the whole of which, as shown in FIG. 15 (*b*), is movable in the vertical direction (in the arrow line d direction), it is necessary to dispose a seat vertical switch operation shaft which can be operated by means of the operation of the same switch knob; and, at the same time, it is also necessary to dispose a seat slide switch operation shaft which is sued to move the power seat 5 in the back-and-forth direction thereof. However, in this structure, differently from the conventional switch knobs 6 and 8 of a seat vertical 2-way type, there are not disposed the fixed shafts 7 and 7*a*; and, therefore, there arises a problem that the present switch knob cannot be fixed.

Further, depending on the types of vehicles, there is another request for development of a new type of seat switch which is structure din the following manner. That is, the new seat switch is capable of not only dealing with the above-mentioned motion of the power set 5 shown in FIG. 15 (*b*) but also serving as the conventional switch knob 1 of a seat vertical 4-way type shown in FIG. 16 (*a*) to thereby be above to deal with the motion of the power seat 5 shown in FIG. 16 (*c*) (that is, the movements of the power seat 5 in the a, b and c directions), so that, in the new seat switch, some parts of the above-mentioned two types of seat switches can be used in common to thereby reduce the cost of the seat switch.

SUMMARY OF THE INVENTION

The present invention aims at eliminating the drawbacks found in the above-mentioned conventional seat switches. Accordingly, it is an object of the invention to provide a seat switch which can be used to operate not only a power seat of a seat vertical 4-way type but also a power seat of a seat vertical 2-way type, while allowing common use of some switch parts thereof in its two kinds of operations for dealing with the movements of the above two types of power seats to thereby be able to reduce the cost thereof, and also which can be operated in such directions that correspond to the movements of the above two types of power seats.

[Means for Solving the Problems]

In attaining the above object, according to the invention there is provided a seat switch including a case main body, a first seat vertical switch, a seat slide switch and a second seat vertical switch respectively arranged within the case main body in this order, the seat switch comprising: a first operation member, when operated in a first operation direction, for switchingly driving the first seat vertical switch; a second operation member, when operated in a second operation crossing the first operation direction, for switchingly driving the seat slide switch; a third operation member disposed at the opposite position to the first operation member with the second operation member between them and, when operated in the same direction as the first operation member or in the first operation direction, for switchingly driving the second seat vertical switch; a restrict member disposed in the case main body and structured such that, when the first and third operation members are operated in the first operation direction, it permits the movements of the first and third operation members in the first operation direction and, when the second operation member is operated in the second operation direction, it prevents the movements of the first and third operation members in the second operation direction; and, a first operation knob member including first and third engaging portions respectively operationally connected to the first and third operation members as well as a second engaging portion operationally connected to the second operation member, the first and third engaging portions being structured such that, when operated in a first operation direction, they drive the first and third operation members respectively in the first operation direction and, when operated in a second operation direction, they are respectively moved with respect to the first and third operation members, and the second engaging portion being structured such that, when operated in a second operation direction, it drives the second operation member in the second operation direction and, when operated in a first operation direction, it is moved with respect to the second operation member.

Also, according to the invention, there is provided a seat switch including a case main body, a first seat vertical switch, a seat slide switch and a second seat vertical switch respectively arranged within the case main body, the seat switch comprising: a fourth operation member, when operated in a first operation direction, for switchingly driving the first seat vertical switch; a second operation member, when operated in a second operation crossing the first operation direction, for switchingly driving the seat slide switch; a restrict member disposed in the case main body and structured such that, when the fourth operation member is operated in the first operation direction, it permits the movement of the fourth operation member in the first operation direction and, when the second operation member is operated in the second operation direction, it prevents the movement of the fourth operation member in the second operation direction; and, a second operation knob member including a fourth engaging portion operationally connected to the fourth operation member as well as a fifth engaging portion operationally connected to the second operation member, the fourth engaging portion being structured such that, when operated in a first operation direction, it drives the fourth operation member in the first operation direction and, when operated in a second operation direction, it is moved with respect to the fourth operation member, and the fifth engaging portion being structured such that, when operated in a second operation direction, it drives the second operation member in the second operation direction and, when operated in a first operation direction, it is moved with respect to the second operation member.

In the present specification, referring in particular to the first operation direction, when a member is operated to move on an arbitrary straight line between the ends thereof, the first operation direction means two directions consisting of a direction in which the member moves one end of the straight line to the other end thereof, and a direction in which the member moves back from the other end to one end. That is, the first operation direction includes two mutually opposite directions, for example, upward and downward directions (vertical direction), right and left directions, and the like. Also, the second operation direction includes two mutually opposite directions in the same sense as the first operation direction.

Therefore, according to the invention when an operator wants to switch and operate the first seat vertical switch, the side of the first operation knob member where the first operation member is disposed may be operated in the firs operation direction (a going direction or a return direction). Due to this operation, the first operation member operationally connected to the first engaging portion is driving or moved in the first operation direction and, owing to the movement of the first operation member, the first seat vertical switch is switchingly operated. At the then time, since the second operation member is prevented by the restrict member from moving in the second operation direction, the second operation member is caused to stop at the then position and, therefore, the second engaging portion of the first operation knob member is moved with respect to the second operation member.

Also, when the operator wants to switchingly operate the second seat vertical switch, the side of the first operation knob member where the third operation member is disposed may be operated in the first operation direction (a going direction or a return direction). due to this operation, the third operation member operationally connected to the third engaging portion is driven or moved in the first operation direction and, owing to the movement of the third operation member, the third seat vertical switch is switchingly operated. At the then time, since the second operation member is prevented by the restrict member from moving in the second operation direction, the second operation member is caused to stop at the then position and, therefore, the second engaging portion of the first operation knob member is moved with respect to the second operation member.

Next, when the operator wants to switchingly operate the seat slide switch, the side of the first operation knob member where the second operation member is disposed may be operated in the second operation direction (a going direction or a return direction). Due to this operation, the second operation member operationally connected to the second engaging portion is driven or moved in the second operation direction and, owing to the movement of the second operation member, the set slide switch is switchingly operated. At the then time, since the first and third operation members are respectively prevented by the restrict member from moving in the second operation direction, the first and third operation members are respectively caused to stop at the then positions and, therefore, the first and third engaging portions of the first operation knob member is moved with respect to the first and third operation members.

According to the invention, when the operator wants to switch and operate the first seat vertical switch, the side of the second operation knob member where the fourth operation member is disposed may be operated in the first operation direction (a going direction or a return direction). Due to this operation, the fourth operation member operationally connected to the fourth engaging portion is driven or moved in the first operation direction and, owing to the movement of the fourth operation member, the first seat vertical switch is switchingly operated. At the then time, since the second operation member is prevented by the restrict member from moving in the second operation direction, the second operation member is caused to stop at the then position and, therefore, the fifth engaging portion of the second operation knob member is moved with respect to the second operation member.

Next, when the operator wants to switchingly operate the seat slide switch, the side of the second operation knob member where the second operation member is disposed may be operated in the second operation direction (a going direction or a return direction). Due to this operation, the second operation member operationally connected to the fifth engaging portion is driven or moved in the second operation direction and, owing to the movement of the second operation member, the seat slide switch is switched and operated. At the then time since the fourth operation member is prevented by the restrict member from moving in the second operation direction, the fourth operation member is caused to stop at the then position and, therefore, the fifth engaging portion of the second operation knob member is moved with respect to the fourth operation member.

DETAILED DESCRIPTION OF THE PREFERRED EMBODIMENTS OF THE INVENTION

Now, description will be given below of a first embodiment of a seat switch according to the invention with reference to FIGS. 1 to 9, that is, a seat switch of a seat vertical 4-way type for use in a power seat in which the front and rear portions of the seat surface thereof can be moved individually in the vertical direction.

Figure 1:
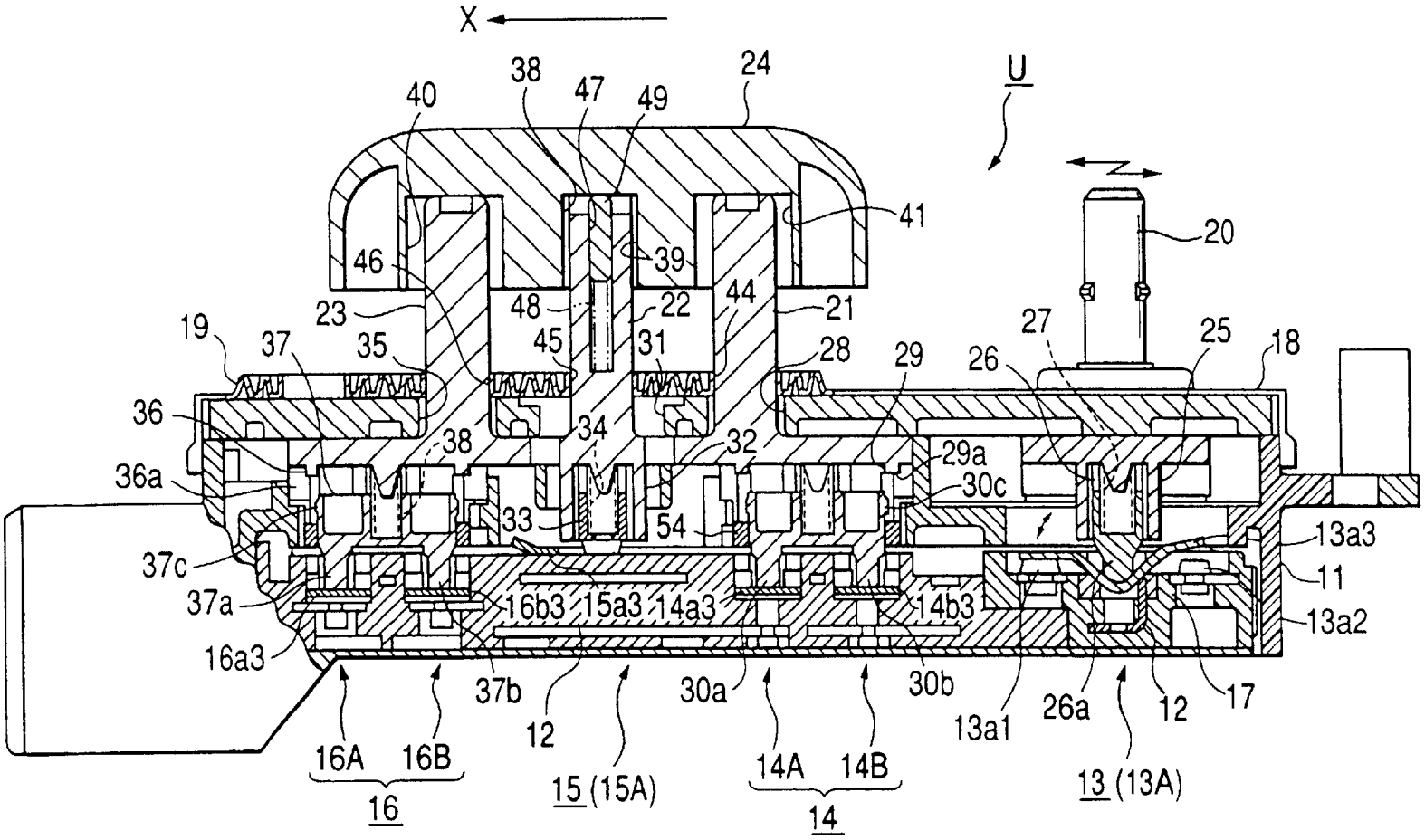
FIG. 1 is a section view of a unit of a first embodiment of a seat switch according to the invention.
Figure 2:
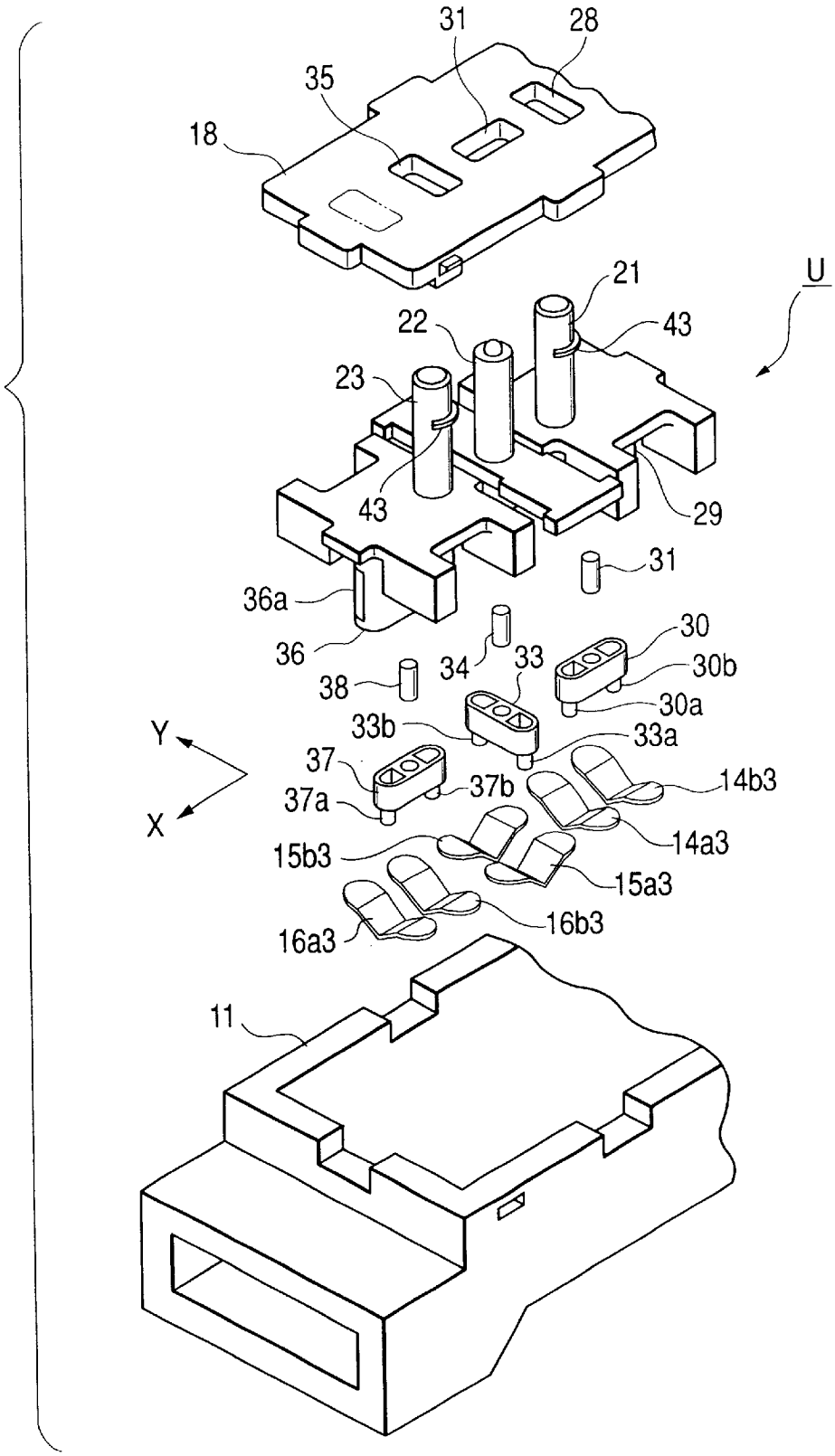
FIG. 2 is an exploded perspective view of the unit of the first embodiment.
Figure 3:
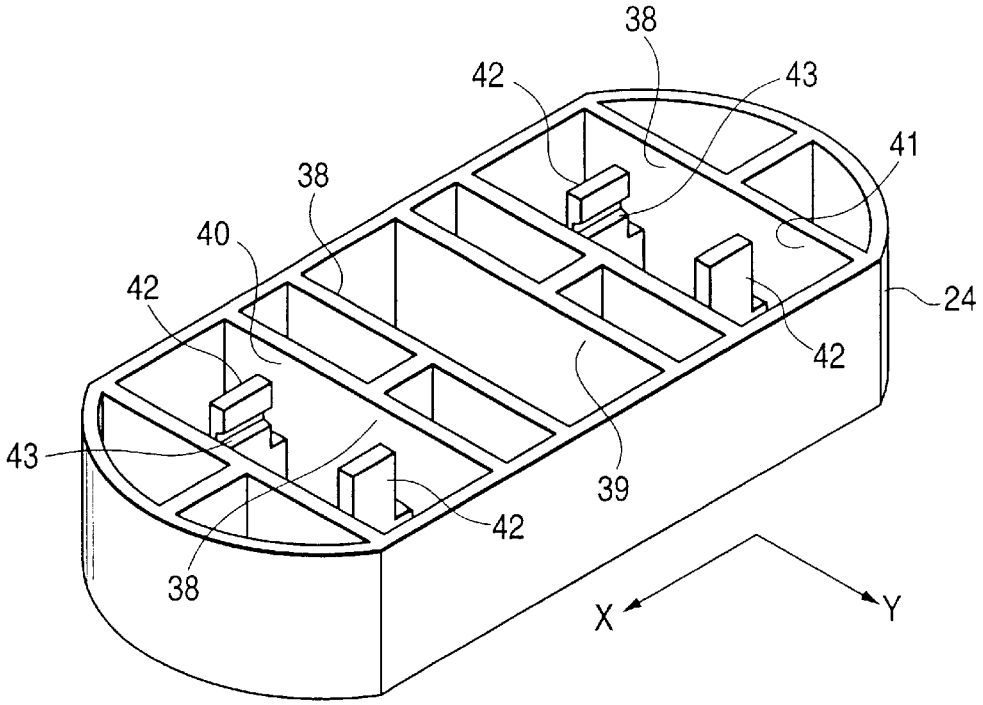
FIG. 3 is a perspective view of a seat switch knob employed in the first embodiment.

FIG. 1 is a section view of a unit forming a seat switch unit according to a first embodiment of the invention, and FIG. 2 in an exploded perspective view of the present seat switch unit. In the following description, reference character X designates a forward direction, Y an upward direction, anti-X a backward direction, and anti-Y a downward direction, respectively. And, in the following embodiments, a first operation direction includes Y and anti-Y directions, where as a second operation direction includes X and anti-X directions. Therefore, the unit U is mounted on the lower side surface of a power seat (not shown) in such a manner that the left end portion thereof shown in FIG. 1 provides the front portion thereof and the right end portion thereof shown in FIG. 1 provides the rear portion thereof.

As shown in FIGS. 1 and 2, the unit U comprises a case main body 11, a substrate 12 stored within the case main body 11, a restriction plate 18 fixed to the case main body 11 in such a manner that it covers an opening formed on the surface side of the case main body 11, and a rubber cover 19 disposed in such a manner that it covers the restriction plate 18 as well as the surface side of the case main body 11. Also, the unit U further includes operation shafts 20–23 respectively for driving their associated switch portions 13–16 disposed in the substrate 12, a seat switch knob 24 for operating the operation shafts 20–23, and the like. The restriction plate 18 forms a restrict member.

The case main body 11 of the unit U is formed of insulating synthetic resin and is formed in a substantially square box shape. Within the case main body 11, there is stored the substrate 12, which includes a plurality of switch portions, from the bottom side of the case main body 11, while the substrate 12 is fixed to the case main body 11. On the substrate 12, there are arranged a reclining switch portion 13, a rear vertical switch portion 14, a seat slide switch portion 15 and a front vertical switch portion 16 in this order from the front portion of the substrate 12 to the rear portion thereof.

The rear vertical switch portion 14 forms a second seat vertical switch. Also, the seat slide switch portion 15 forms a seat slide switch, and a front vertical switch portion 16 forms a first seat vertical switch.

Figure 7:
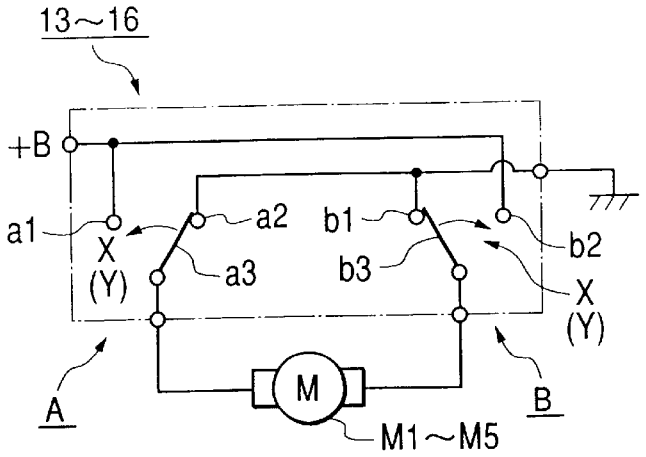
FIG. 7 is an electric circuit diagram employed in each of the switch portions.
Figure 8:
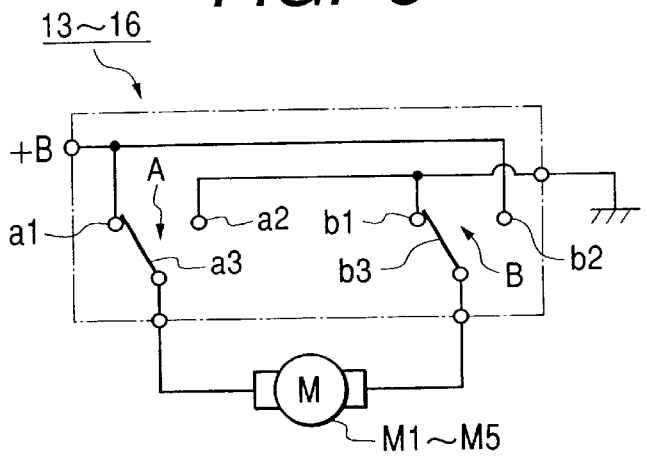
FIG. 8 is an electric circuit diagram employed in each of the switch portions.
Figure 9:
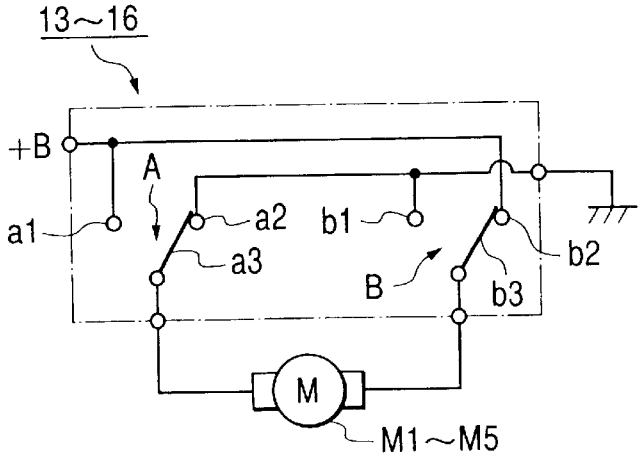
FIG. 9 is an electric circuit diagram employed in each of the switch portions.
Figure 10:
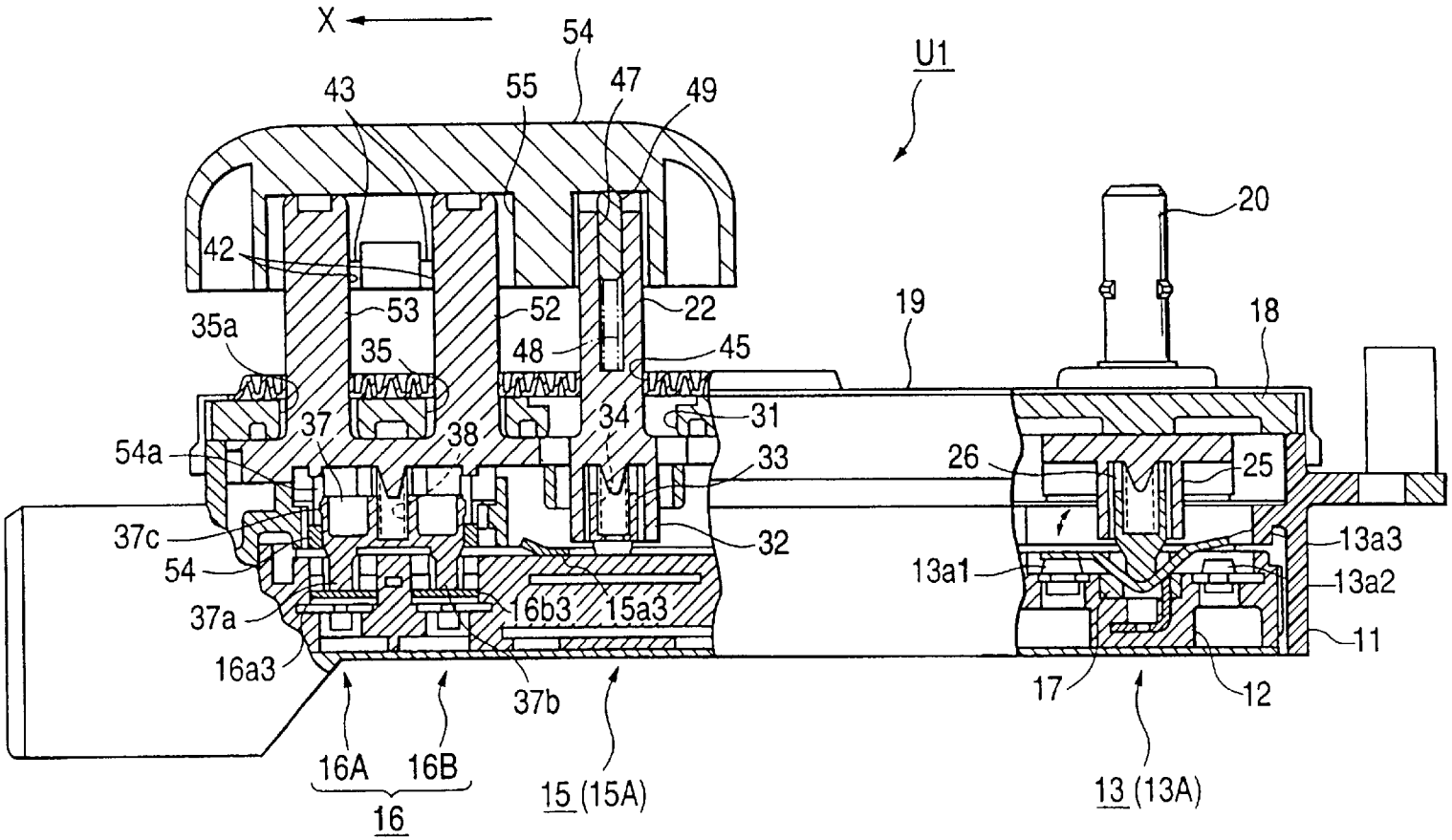
FIG. 10 is a section view of a unit of a second embodiment of a seat switch according to the invention.
Figure 11:
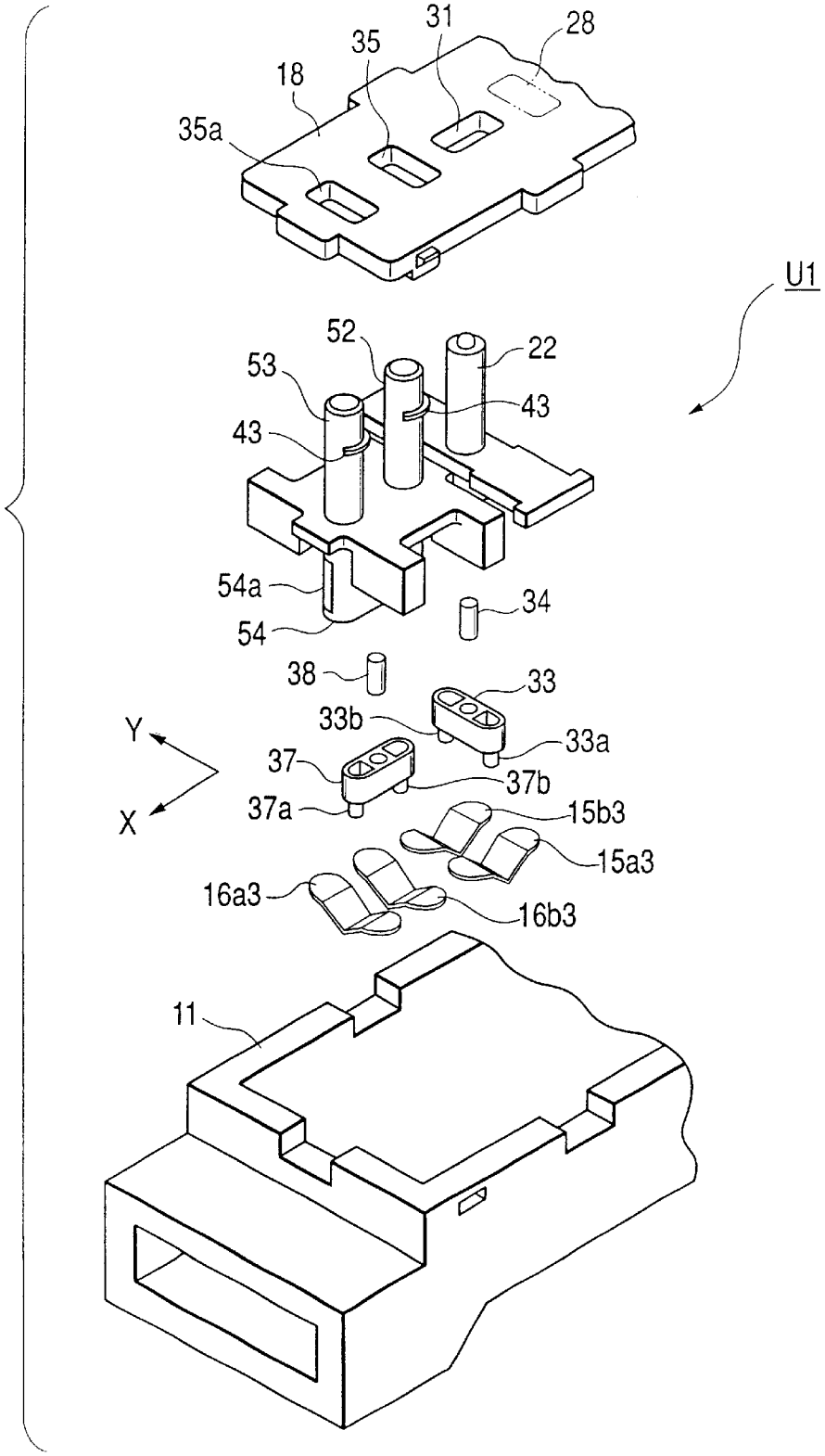
FIG. 11 is an exploded perspective view of the unit of the second embodiment.

Since it is in common to the respective switch portions 13–16 that they include a pair of opening and closing portions A and B respectively, the electrical structure of the reclining switch portion 13 will be firstly described and, with respect to the structure so the remaining switch portions, description will be given mainly of the portions thereof which are different from the structure of the reclining switch portion 13. And, in the opening and closing portions of the respective switch portions 13–16, A and B are added to the reference characters of the respective switch portions. In FIGS. 7 to 9, for the sake of explanation, in reference characters which designate the respective composing members, the reference characters of the respective switch portions are omitted and there are used only the reference characters of the respective composing members (for example, 13A is expressed simply as A and a fixed contact 13*a*1 is expressed simply as a1).

The reclining switch portion 13A includes a pair of opening and closing portion 13A and 13B. In FIG. 1, there is shown only the opening and closing portion 13A, while the opening and closing portion 13B is arranged parallel to the opening and closing portion 13A on the vertical direction (Y direction) side of the sheet of FIG. 1. Because the opening and closing portions 13A and 13B are the same in structure, description will be given below only of the structure of the opening and closing portion 13A whereas the description of the structure of the opening and closing portion 13B is omitted here.

The opening and closing portion 13A is composed of a pair of fixed contacts 13*a*1 and 13*a*2 which are respectively fixed to the substrate 12 and arranged in the X direction and a movable contact 13*a*3 interposed between the two fixed contacts 13*a*1 and 13*a*2. The pair of fixed contacts 13*a*1 and 13*a*2, as shown in FIG. 7, are connected to a power source side terminal and a grounding terminal through the wiring that is formed within the substrate 12.

The movable contact 13*a*3 is formed of a conductive metal member the central portion of which is bent formed in a V shape toward the bottom side of the case main body 11, while two contact ends respectively located on both end portions thereof are bent in such a manner that they can be contacted with their associated fixed contacts 13*a*1 and 13*a*2. Between the pair of fixed contacts 13*a*1 and 13*a*2, a contact ring 17 is fixed to the substrate 12. The contact ring 17 is fitted with the central portion of the movable contact 13*a*3 to support the same in such a manner that the central portion of the movable contact 13*a*3 can be freely swung along an arrow shown in FIG. 1; and, the contact ring 17 is always in contact with the movable contact 13*a*3. And, the contact ring 17 is further connected to a connecting terminal (not shown) through a wiring such as a lead wire or the like formed in the substrate 12.

In the restriction plate 18, at a position thereof which corresponds to the reclining switch portion 13, there is formed an elongated hole (not shown) extending in the X direction, while the reclining operation shaft 20 is projected externally through the elongated hole. In the inner end face of the reclining operation shaft 20, there is formed a fitting cylindrical portion 25. Within the fitting cylindrical portion 25, there is fitted an operation body 26. The operation body 27 includes a pair of projections 26*a* (in FIG. 1, only one of them is shown) which correspond to the respective movable contacts 13*a*3 and 13*b*3 of the two opening and closing portions 13A and 13B. And, the operation body 26 is always pressed against the respective movable contacts 13*a*3 and 13*b*3 of the two opening and closing portions 13A and 13B through a coiled spring 27 which is stored within the central portion of the operation body 26 and extends between the operation body 26 and fitting cylindrical portion 25. The positions of the movable contacts 13*a*3 and 13*b*3 are set so that, in a state where the reclining operation shaft 20 is not in operation, due to such pressing of the operation body 26 by the coiled spring 27, the movable contact 13*a*3 is contacted with the fixed contact 13*a*2 and the movable contact 13*b*3 is contacted with the fixed contact 13*b*1. Into the externally projected end portion of the reclining operation shaft 20, there is fitted an operation knob (not shown).

The reclining switch portion 13, as shown in FIG. 7 and 8, is electrically connected to a battery B and a reclining motor M1. That is, the two fixed contacts 13*a*1 and 13*a*2 of the opening and closing portion 13A are respectively connected to the battery B and grounding conductor, while the two fixed contacts 13*b*2 and 13*b*1 of the opening and closing portion 13B are respectively connected to the battery B and grounding conductor.

And, when the operation know (not shown) is not in operation, due to the energizing force of the coil spring 27, the projections 26*a* of the operation body 26 are guided by the two inclined surfaces of the V-shaped movable contacts 13*a*3 and 13*b*3 of the opening and closing portion 13A and 13B, so that the two projections 26*a* are respectively pressed against the central portions of the movable contacts 13*a*3 and 13*b*3 are set so that, when the reclining operation shaft 20 is not in operation, the movable contact 13*a*3 is contacted with the fixed contact 13*a*2 and the movable contact 13*b*3, as shown in FIG. 7, is contacted with the fixed contact 13*b*1, the present unit U is held at an off position. In FIG. 7, a1, a2, b1 and b2 are respectively the fixed contacts of the opening and closing portions A and B.

Also, if the operation knob (not shown) is operated in the X direction against the energizing force of the coil spring 27, then the projection 26*a* of the operation body 26 is pressed against one inclined surface (X-direction side inclined surface) of the V-shaped movable contact 13*a*3 of the opening and closing portion 13A to thereby move the present inclined surface. As a result of this, the movable contact 13*a*3, in more particular, the x-direction side contact end thereof, as shown in FIG. 1, is contacted with the fixed contact 13*a*1 (in FIG. 8, a1). Therefore, as shown in FIG. 8, the reclining motor M1 to be connected to the present switch portion 13 is driven or rotated forwardly and, due to such forward rotation movement of the motor M1, the seat back (not shown) of the power seat is inclined forwardly.

On the other hand, in the unit U off position shown in FIG. 7, if the operation knob (not shown) is operated in the anti-X direction against the energizing force of the coil spring 27, then the projection 26*b* of the operation body 26 is pressed against one inclined surface (anti-X-direction side inclined surface) of the V-shaped movable contact 13*b*3 of the opening and closing portion 13B to thereby move the present inclined surface. As a result of this, the movable contact 13*b*3, in more particular, the anti-X-direction side contact end thereof, as shown in FIG. 1, is contacted with the fixed contact 13*b*2 (in FIG. 9, b2). Therefore, as shown in FIG. 9, the reclining motor M1 to be connected to the present switch portion 13 is driven or rotated reversely and, due to such reverse rotation of the motor M1, the seat back (not shown) of the power seat is inclined backwardly.

In FIGS. 7 to 9, reference character +B designates a battery power source which is to be carried on board a vehicle.

Next, description will be given below of the rear vertical switch portion 14.

The present rear vertical switch portion 14 is different from the above-mentioned reclining switch portion 13 only in the operation direction thereof, and the electrical connection of the rear vertical switch portion 14 is similar to that of the reclining switch portion 13. Therefore, the description thereof is omitted here and description will be given below mainly of the different structure thereof.

Figure 5:
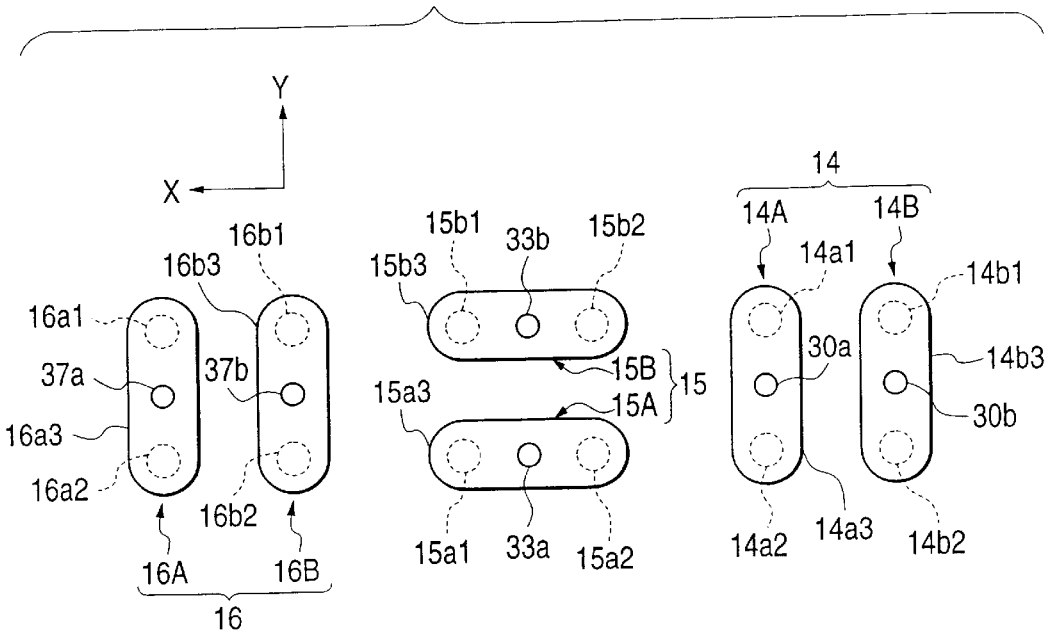
FIG. 5 is an explanatory view of the position relations between the respective switch portions of the first embodiment.
Figure 6:
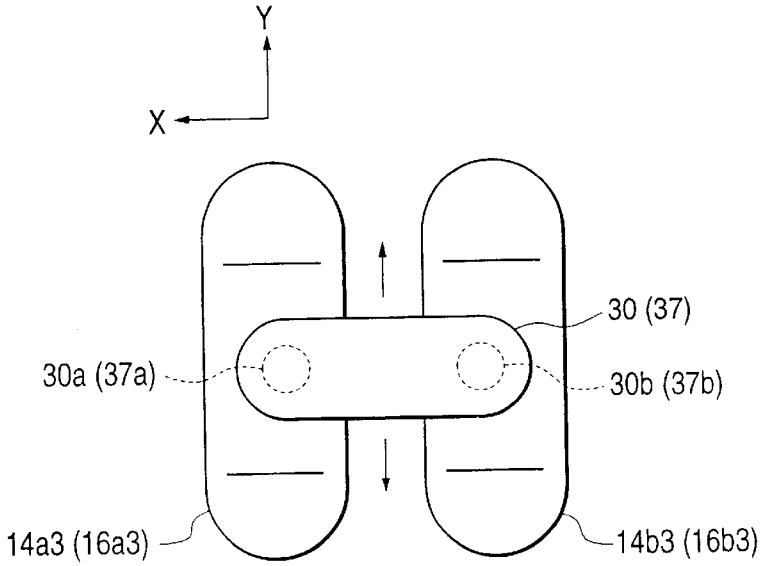
FIG. 6 is an explanatory view of the mutual relations between an operation body and the switch portions.

Now, FIG. 5 is an explanatory view of the positional arrangement of the switch portions 14 to 16. As shown in FIGS. 1 and 5, the rear vertical switch portion 14 includes a pair of opening and closing portions 14A and 14B. The opening and closing portions 14A and 14B respectively include a pair of fixed contacts 14*a*1 and 14*a*2 and a pair of fixed contacts 14*b*1 and 14*b*2 which are respectively fixed to the substrate 12 and arranged in the Y direction, and movable contacts 14*a*3 and 14*b*3 which are respectively interposed between their associated two fixed contacts 14*a*1 and 14*a*2 as well as between two fixed contacts 14*b*1 and 14*b*2. The pair of fixed contacts 14*a*1 and 14*a*2, as shown in FIG. 7, are respectively connected to the power source side terminal and grounding conductor through the wiring formed in the substrate 12. The shaped of the movable contacts 14*a*3 and 14*b*3 are the same as those of the above-mentioned movable contacts 13*a*3 and 13*b*3, while the contact ends of the movable contact 14*a*3 and 14*b*3 located on their respective two ends are respectively structured such that they can be contacted with and removed from their associated fixed contacts 14*a*1 and 14*a*2.

Referring further to the structure of the movable contacts 14*a*3 and 14*b*3, similarly to the previously described movable contacts 13*a*3 and 13*b*3, the central portions thereof are fitted with supported by their respective contact rings (not shown) in such a manner that they can be swung freely along the Y direction. The contact rings are respectively connected to a connecting terminal (not shown) by wiring such as a lead wire or the like formed in the substrate 12.

In the restriction plate 18, at a position thereof which corresponds to the seat surface rear portion vertical switch portion 14, there is formed an elongated hole 28, while the rear seat surface operation shaft 21 is projected externally through the elongated hole 28. In the inner end face of the rear seat surface operation shaft 21, there is formed a fitting cylindrical portion 29. Within the fitting cylindrical portion 29, there is fitted an operation body 30. In the respective side walls of the two end portions of the fitting cylindrical portion 29, there are formed slits 29*a* in such a manner that they respectively extend through their associated end portion side walls of the fitting cylindrical portion 29; and, within each of the slits 29*a*, there is engaged the projected guide portion 30*a* of the operation body 30 in such a manner that it can be freely slided in the same direction as the axial direction of the rear seat surface operation shaft 21.

In the operation body 30, there are disposed a pair of projections 30*a* and 30*b* (see FIGS. 1 and 6) which respectively correspond to the respective movable contacts 14*a*3 and 14*b*3 of the opening and closing portion 14A and 14B. And, the operation body 30 is always pressed against the respective molded contacts 14*a*3 and 14*b*3 of the two opening and closing portion 14A and 14B through a coil spring 31 which is stored within the central portion of the operation body 30 and extends between the operation body 30 and fitting cylindrical portion 29. The positions of the movable contacts 14*a*3 and 14*b*3 are set so that, in a state where the rear seat surface operation shaft 21 is not in operation, due to such pressing of the operation body 30 by the coil spring 27, the movable contact 14*a*3 contacted with the fixed contact 14*a*2 and the movable contact 14*b*3 contacted with the fixed contact 14*b*1. And, the rear seat surface operation shaft 21 forms a third operation member.

Next, description will be given below of the seat slide switch portion 15.

The present seat slide switch portion 15 is structured in such a manner that it can be operated in the same direction as the reclining switch portion 13, and the electrical connection of the seat slide switch portion 15 is similar to that of the reclining switch portion 13. Therefore, the description thereof is omitted here and description will be given below mainly of the structure thereof that is different from the reclining switch portion 13.

As shown in FIGS. 1 and 5, the seat slide switch portion 15 comprises a pair of opening and closing portion is 15A and 55B. The opening and closing portions 15A and 15B are respectively composed of a pair of fixed contacts 15*a*1, 15*a*2 and a pair of fixed contacts 15*b*1, 15*b*2 which are respectively fixed to the substrate 12 and arranged in the X direction, and movable contacts 15*a*3 and 15*b*3 which are respectively interposed between their associated pair of fixed contacts 15*a*1, 15*a*2 and pair of fixed contacts 15*b*1, 15*b*2. The pair of fixed contacts 15*a*1 and 15*a*2 are respectively connected to the power source terminal and grounding terminal in such a manner as shown in FIG. 7 through the wiring formed in the substrate 12. The movable contacts 15*a*3 and 15*b*3 are the same in structure as the previously described movable contacts 13*a*3 and 13*b*3, while the respective contact ends of the movable contacts 15*a*3 and 15*b*3 located on the respectively two ends thereof can be respectively contacted with their associated pair of fixed contacts 15*a*1, 15*a*2 and pair of fixed contacts 15*b*1, 15*b*2.

The movable contacts 15*a*3 and 15*b*3, similarly to the movable contacts 13*a*3 and 13*b*3, are respectively fitted with and supported by a contact ring (not shown) in such a manner that the respective central portions thereof can be freely swung along the Y direction. The present contact ring is connected to a connecting terminal (not shown) by a wiring such as a lead wire or the like provided on the substrate 12.

In the restriction plate 18, at a position thereof which corresponds to the seat slide switch portion 15, there is formed an elongated hole 31 which extends in the X direction, while the seat slide operation shaft 22 if projected outwardly through the elongated hole 31. In the inner end face of the seat slide operation shaft 22, there is formed a fitting cylindrical portion 32. Within the fitting cylindrical portion 32, there is fitted an operation body 33. In the side walls of the two ends of the fitting cylindrical portions 32, there are respectively formed through holes (not shown); and, within the through holes, there are respectively engaged guide projecting portions (not shown) which project from the operation body 33 in such a manner that they can be freely slide in the same direction as the axial direction of the seat side operation shaft 22. In the operation body 33, there are provided a pair of projections 33*a* and 33*b* in such a manner that they respectively correspond to the two movable contacts 15*a*3 and 15*b*3 of the opening and closing portions 15A and 15B. And, the operation body 33 is always pressed against the two movable contacts 15*a*3 and 15*b*3 of the opening and closing portions 15A and 15B through a coil spring 34 which is stored within the central portion of the operation body 33 and extend between the operation body 33 and fitting cylindrical portion 32. The positions of the movable contacts 15*a*3 and 15*b*3 are set such that, in a state where the seat slide operation shaft 22 is not in operation, due to such pressing of the operation body 33 by the coil spring 34, the movable contact 15*a*3 contacted with the fixed contact 15*a*2 and the movable contact 15*b*3 contacted with the fixed contact 15*b*2. The seat slide operation shaft 22 forms a second operation member.

Next, description will be given below of the front vertical switch portion 16.

The present front vertical switch portion 16 is different from the above-mentioned reclining switch portion 13 only in the operation direction thereof, and the electrical connection of the front vertical switch portion 16 is similar to that of the reclining switch portion 13. Therefore, the description thereof is omitted here and description will be given below mainly of the different structure thereof.

As shown in FIGS. 1 and 5, the front vertical switch portion 16 includes a pair of opening and closing portions 16A and 16B. The opening and closing portions 16A and 16B are respectively composed a pair of fixed contacts 16*a*1 and 16*a*2 and a pair of fixed contacts 16*b*1 and 16*b*2 which are respectively fixed to the substrate 12 and arranged in the Y direction, and movable contacts 16*a*3 and 16*b*3 which are respectively interposed between their associated pair of fixed contacts 16*a*1 and 16*a*2 and pair of fixed contacts 16*b*1 and 16*b*2. The pair of fixed contacts 164*a*1 and 16*a*2 are respectively connected to the power source side terminal and grounding conductor in such manner as shown in FIG. 7 through the wiring formed in the substrate 12. The shapes of the movable contacts 16*a*3 and 16*b*3 are the same as those of the above-mentioned movable contacts 13*a*3 and 13*b*3, while the contact ends of the movable contacts 16*a*3 and 16*b*3 located on their respective two ends are respectively structured such that they can be contacted with and removed from their associated fixed contacts 16*a*1 and 16*a*2.

Referring further to the structure of the movable contacts 164*a*3 and 16*b*3, similarly to the previously described movable contacts 13*a*3 and 13*b*3, the central portions thereof are fitted with and supported by a contact ring (not shown) in such a manner that the respective central portions thereof can be swung freely along the Y direction. The present contact ring is connected to a connecting terminal (not shown) by a wiring such as a lead wire or the like formed in the substrate 12.

In the restriction plate 18, at a position thereof which corresponds to the front vertical switch portion 16, there is formed an elongated hole 35 which extends in the Y direction, while the front seat surface operation shaft 23 is projected externally through the elongated hole 35. In the inner end face of the front seat surface operation shaft 23, there is formed a fitting cylindrical portion 36. Within the fitting cylindrical portion 36, there is fitted an operation body 37. In the respective side walls of the two end portions of the fitting cylindrical portion 36, there are portion formed slits 36*a* in such a manner that they respectively extend through their associated side walls; and, within each of the slits 36*a*, there is engaged the projected guide portion 37*a* of the operation body 37 in such a manner that it can be freely slide in the same direction as the axial direction of the front seat surface operation shaft 23.

In the operation body 37, there are disposed a pair of projections 37*a* and 37*b* (see FIGS. 1 and 6) which respectively correspond to the respective movable contacts 16*a*3 and 16*b*3 of the opening and closing portions 16A and 16B. And, the operation body 37 is always pressed against the respectively movable contacts 16*a*3 and 16*b*3 of the two opening and closing portion 16A and 16B through a coil spring 38 which is stored within the central portion of the operation body 37 and extends between the operation body 37 and fitting cylindrical portion 36. The positions of the movable contacts 16*a*3 and 16*b*3 are set so that, in a state where the rear seat surface operation shaft 23 is not in operation, due to such pressing of the operation body 37 by the coil spring 38, the movable contact 164*a*3 contacted with the fixed contact 16*a*2 and the movable contact 16*b*3 contacted with the fixed contact 16*b*1. And, the front seat surface operation shaft 23 forms a first operation member.

Next, description will be given below of the seat switch knob 24 serving as a first operation knob member.

The seat switch knob 24, as shown in FIG. is, comprises a slide operation shaft engaging chamber 39 formed in the central portion of the bottom surface thereof, an X side operation shaft engaging chamber 40 formed in the X-direction side end portion thereof, and an anti-Y side operation shaft engaging chamber 41 formed in the anti-Y-direction side end portion thereof, while these chambers are respectively defined by their associated partition walls 38. The partition wall 38 of the slide operation shaft engaging chamber 39 forms a second engaging portion.

The slide oration shaft engaging chamber 39 is formed such that it extend sin the Y direction and has a rectangular-shaped section and, into the slide operation shaft engaging chamber 39, there is fitted the seat slide operation shaft 22 in such a manner that it can be moved in the anti-Y-direction and can be rotated in a reciprocating manner. Also, in the leading end of the seat slide operation shaft 22, as shown in FIG. 1, there is formed a storage hole 47; and, a coil spring 48 and a pressing member 49 are respectively stored within the storage hole 47. And, the pressing member 49 is always pressed by the coil spring 48 against the inner top surface of the slide operation shaft engaging chamber 39.

Figure 4:
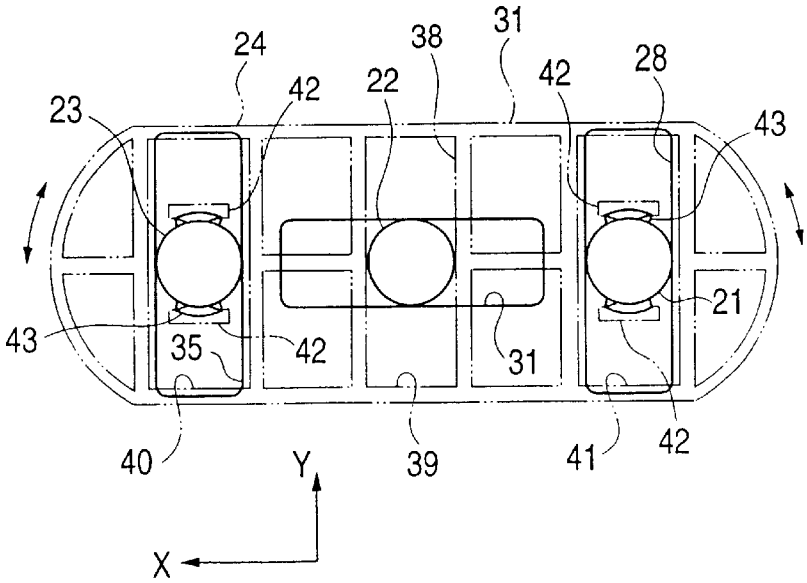
FIG. 4 is an explanatory view of the mutual relation between the respective operation shafts and the seat switch knob in the first embodiment.

Also, in each of the X side operation shaft engaging chamber 40 and anti-Y side operation shaft engaging chamber 41, there are disposed a pair of hold pieces 42 which are spaced from each other in the Y direction and are respectively projected from their associated inner top surface thereof. The hold pieces 42 have elasticity. In the leading ends of the mutually opposing hold pieces 42, there are formed fitting grooves 43 which respectively extend in the width direction (X direction or anti-X direction) of their associated hold pieces 42. And, as shown in FIG. 4, the respective end portions of the rear seat surface operation shaft 21 and front seat surface operation shaft 23 are held by the mutually opposing hold pieces 42 of the X side operation shaft engaging chamber 40 and anti-Y side operation shaft engaging chamber 41 in such a manner that the shafts 21 and 23 can be respectively rotated with respect to their associated hold pieces 42. Also, in the end portions of the rear seat surface operation shaft 21 and front seat surface operation shaft 23, there are respectively formed engaging projections 43; and, the engaging projections 43 are respectively engaged into the fitting grooves 43 of their associated hold pieces 42. As a result of this, the seat switch knob 24 is prevented against removal from the rear seat surface operation shaft 21 and front seat surface operation shaft 23.

The hold pieces 42 within the X side operation shaft engaging chamber 40 and anti-Y side operation shaft engaging chamber 41 respectively form first and third engaging portions.

Also, as shown in FIG. 4, the X-direction lengths of the X side operation shaft engaging chamber 40 and anti-Y side operation shaft engaging chamber 41 are set longer than the diameters of the rear seat surface operation shaft 21 and front seat surface operation shaft 23, thereby allowing the X and anti-X direction relative movements of the rear seat surface operation shaft 21 and front seat surface operation shaft 23 with respect to their associated hold pieces 42. That is, when the seat switch knob 24 is operated in the X or anti-X direction, the movements of the rear seat surface operation shaft 21 and front seat surface operation shaft 23 are respectively restricted in the X and anti-X directions by their associated elongated holes 28 and 35, which allows the relative movements of the seat switch knob 24 with respect to the rear seat surface operation shaft 21 and front seat surface operation shaft 23, so that the seat slide operation shaft 22 can be moved smoothly in the X direction.

Also, when the seat switch knob 24 is operated in the y direction or in the anti-Y direction while holding the X-direction side end portion thereof or the anti-X direction side end portion thereof, since the Y-direction or anti-Y-direction movement of the seat slide operation shaft 22 is restricted by the elongated hole 31, the seat switch knob 24 can be rotated clockwise or counterclockwise around the axis of the rear seat surface operation shaft 21.

In the above-mentioned cover 19, as shown in FIG. 1, there are formed through holes 44–46 (in FIG. 1, there are shown, among them, only the through holes formed in the rear seat surface operation shaft 21, seat slide operation shaft 22 and front seat surface operation shaft 23) in such a manner that they respectively correspond to the relining operation shaft 20, rear seat surface operation shaft 21, seat slide operation shaft 22 and front seat surface operation shaft 23.

Now, description will be given below of the operation of the above-mentioned unit U.

The switch portion 14, 15 and 16 of the present unit U, when assembled to the power seat of the vehicle, are respectively connected to the battery power source B, seat rear portion seat surface driving motor M2, seat sliding motor M3, and seat front side seat surface driving motor M4, as shown in FIG. 7. That is, the fixed contacts a1 and a2 of the opening and closing portions A of the respective switch portions 14–16 are respectively connected to the battery power source B and grounding conductor, while the fixed contacts b2, b1 of the opening and closing portions B of the respective switch portions 14–16 are respectively connected to the battery power source B and grounding conductor.

And, when the seat switch knob 24 is not in operation, the projections 30*a*, 30*b*, 33*a*, 33*b*, 37*a* and 37*b* of the operation bodies 30, 33 and 37 are guided by the two-side inclined surfaces of the V-shaped movable contacts a3 of the respective opening and closing portions A and B due to the energizing forces of the coil springs 31, 34 and 38, so that the projections 30*a*, 30*b*, 33*a*, 33*b*, 37*a* and 37*b* are pressed against the movable contacts a3 in their respective central portions thereof.

And, since the positions of the movable contacts a3 and b3 of the respective switch portions 14–16 are set such that the movable contacts a3 are contacted with their associated fixed contacts a2, whereas the movable contacts b3, as shown in FIG. 7, are contacted with their associated fixed contacts b1, with the result that the unit U is switched over to its off position.

Therefore, in this state, the power seat of the vehicle is held in a stationary condition.

{Seat Sliding Operation}

When an operator wants to slide the power seat, for example, in the X direction, the seat switch 24 may be operated in the X direction against the energizing force of the coil spring 34. In response to this, the seat slide operation shaft 22 is driven by the seat switch knob 24 and is thereby moved to the X direction. As a result of this, the projection 33*a* of the operation body 33 is pressed against one (X-direction side) included surface of the V-shaped movable contact 15*a*3 of the opening and closing portion 15 to thereby move the present inclined surface. Due to this, the X-direction side contact end of the movable contact 15*a*3 contacted with the fixed contact 15*a*1 (in FIG. 8, a1). Therefore, as shown in FIG. 8, the seat sliding motor M3 to be connected to the present switch portion 15 is driven or rotated forwardly and, due to such forward rotation of the motor M, the power seat is moved forward in the X direction.

On the other hand, in the off state shown in FIG. 7, if the switch knob 24 is operated in the anti-X direction against the energizing force of the coil spring 34, then the projection 33*b* of the operation body 33 is pressed against one (anti-X-direction side) inclined surface of the V-shaped movable contact 15*b*3 of the opening and closing portion 15 to thereby move the present inclined surface. Due to this, the anti-X-direction side contact end of the movable contact 15*b*3 contacted with the fixed contact 15*b*2 (in FIG. 9, b2). Therefore, as shown in FIG. 9, the seat sliding motor M3 to be connected to the present switch portion 15 is driven or rotated reversely and, due to such reverse rotation of the motor M3, the power seat is moved forward in the anti-X direction.

(Operation of Seat Rear Portion Seat Surface)

When the operator wants to move up the rear portion seat surface of the power seat, for example, in the Y direction, the anti-X-direction end portion (rear end portion) of the seat switch knob 24 may be operated in the Y direction against the energizing force of the coil spring 31. In response to this, the seat switch knob 24 is rotated counterclockwise about the seat slide operation shaft 22 and, due to the counterclockwise rotation of the seat switch knob 24, the seat rear portion seat surface operation shaft 21 is driven by the seat switch knob 24 and is thereby moved in the Y direction. As a result of this, the projections 30*a* and 30*b* of the operation body 30 are respectively pressed against one (Y-direction side) inclined surface of the V-shaped movable contact 14*a*3 of the opening and closing portion 14A to thereby move the present inclined surface. As a result of this, the Y-direction side contact end of the movable contact 14*a*3 contacted with the fixed contact 14*a*1 (in FIG. 8, a1). Accordingly, as shown in FIG. 8, the seat rear portion seat surface driving motor M2 to be connected to the present switch portion 14 is driven or rotated forwardly and, due to such forward rotation of the motor M2, the rear portion seat surface of the power seat is moved up in the Y direction.

On the other hand, in the off state shown in FIG. 7, if the anti-X-direction end portion (rear end portion) of the seat switch knob 24 is operated in the anti-Y direction against the energizing force of the coil spring 31, then the seat switch knob 24 is rotated clockwise about the seat slide operation shaft 22 and, due to the clockwise rotation of the seat switch knob 24, the projection 30*b* of the operation body 30 is pressed against one (anti-Y-direction side) inclined surface of the V-shaped movable contact 14*b*3 of the opening and closing portion 14B to thereby move the present inclined surface. As a result of this, the Y-direction side contact end of the movable contact 14*b*3 contacted with the fixed contact 14*b*2 (in FIG. 9, b2). Accordingly, as shown in FIG. 9, the seat rear portion seat surface driving motor M2 to be connected to the present switch portion 14 is driven or rotated reversely and, due to such reverse rotation of the motor M2, the rear portion seat surface of the power seat is moved down in the anti-Y direction.

(Operation of Seat Front Portion Seat Surface)

When the operator wants to move up the front portion seat surface of the power seat, for example, in the Y direction, the X-direction end portion (front end portion) of the seat switch knob 24 may be operated in the Y direction against the energizing force of the coil spring 38. In response to this, the seat switch knob 24 is rotated clockwise about the seat slide operation shaft 22 and, due to the clockwise rotation of the seat switch knob 24, the seat front portion seat surface operation shaft 23 is driven by the seat switch knob 24 and is thereby moved in the Y direction. As a result of this, the projection 37*a* of the operation body 37 is pressed against one (Y-direction side) inclined surface of the V-shaped movable contact 16*a*3 of the opening and closing portion 16A to thereby move the present inclined surface. As a result of this, the Y-direction side contact end of the movable contact 16*a*3 is contacted with the fixed contact 16*a*1 (in FIG. 8, a1). Thus, as shown in FIG. 8, the seat front portion seat surface driving motor M4 to be connected to the present switch portion 16 is driven or rotated forwardly and, due to such forward rotation of the motor M4, the front portion seat surface of the power seat is moved up in the Y direction.

On the other hand, in the off state shown in FIG. 7, if the X-direction end portion (front end portion) of the seat switch knob 24 is operated in the anti-Y direction against the energizing force of the coil spring 38, then the seat switch knob 24 is rotated counterclockwise about the seat slide operation shaft 22 and, due to the counterclockwise rotation of the seat switch knob 24, the projection 37*b* of the operation body 37 is pressed against one (anti-Y-direction side) inclined surface of the V-shaped movable contact 16*b*3 of the opening and closing portion 16B to thereby move the present inclined surface. As a result of this, the Y-direction side contact end of the movable contact 16*b*3 is contacted with the fixed contact 16*b*2 (in FIG. 9, b2). Thus, as shown in FIG. 9, the seat rear portion seat surface driving motor M4 to be connected to the present switch portion 14 is driven or rotated reversely and, due to such reverse rotation of the motor M4, the front portion seat surface of the power seat is moved in anti-Y-direction.

Next, description will be given below of the effects of the unit U structured in the above-mentioned manner.

(1) In the present embodiment, when the operator wants to move up the rear portion seat surface of the power seat in the Y direction or move down it in the anti-Y direction, if the anti-X-direction side end portion (rear end portion) of the seat switch knob 24 is operated in the Y direction or in the anti-Y direction, then the seat switch knob 24 can be rotated clockwise or counterclockwise about the seat slide operation shaft 22. And, in correspondence to the operation direction of the seat switch knob 24, the front portion seat surface of the power seat can be moved up or down.

(2) Also, in the present embodiment, when the operator wants to move up the front portion seat surface of the power seat in the Y direction or move it down in the anti-Y direction, if the X-direction side end portion (front end portion) of the seat switch knob 24 is operated in the Y direction or in the anti-Y direction, then the seat switch knob 24 can be rotated clockwise or counterclockwise about the seat slide operation shaft 22. And, in correspondence to the operation direction of the seat switch knob 24, the front portion seat surface of the power seat can be moved up or down.

(3) Further, in the present embodiment, when the operator wants to slide the power seat in the X direction (in the forward direction) or in the anti-X direction (in the backward direction), if the seat switch knob 24 is operated in the X direction or in the anti-X direction, then the seat switch knob 24 can be moved in the same direction. And, in correspondence to the operation direction of the seat switch knob 24, the power seat can be moved in the same direction as the operation direction of the seat switch knob 24.

(Second Embodiment)

Next, description will be given below of a second embodiment of a seat switch according to the invention with reference to FIGS. 10–14. The second embodiment provides a seat switch for use in a power seat of a seat vertical 2-way type which is structured such that the whole seat surface thereof can be moved up or down in the vertical direction. In the second embodiment, parts thereof, which are the same in structure as those in the first embodiment or correspond in structure to those in the first embodiment, are given the same designations and thus the description thereof is omitted here; and, description will be given mainly of the portions of the second embodiment that are different in structure from the first embodiment.

In FIGS. 10–14, there is shown a unit U1 of a seat switch according to the second embodiment of the invention. The unit U1 comprises a case main body 11, a substrate 12 stored within the case main body 11, a restriction plate 18 fixed to the case main body 11 in such a manner that it covers an opening formed on the front surface side of the case main body 11, and a rubber cover 19 disposed in such a manner that it covers the restrict plate 18 and the front surface side of the case main body 11.

Also, the unit U1 further includes operation shafts 20, 22, 52 and 53 respectively used to drive switch portions 13, 15 and 16 formed in the substrate 12, and a switch knob 54 used to operate the respective operation shafts 20, 22, 52 and 53.

And, the case main body 11 and substrate 12 of the second embodiment are the same in structure as the case main body 11 and substrate 12 of the first embodiment. Therefore, the substrate 12 includes the fixed contacts that form the switch portions 13–16 in the first embodiment. The movable contacts 14*a*3 and 14*b*3 of the switch portion 14 in the first embodiment are omitted in the second embodiment and, at the same time, the operation shaft 21, coil spring 31 and operation body 30 are also omitted here.

Also, in the restrict plate 18 of the present embodiment, there is omitted the elongated hole 28 that is employed in the first embodiment and, instead of the elongated hole 28, on the X-direction side of the restriction plate 18 with respect to the elongated hole 35, there is formed an elongated hole 35*c* which is the same in structure as the elongated hole 35 and extends through the restrict plate 18 in parallel to the elongated hole 35. And, a first seat surface operation shaft 52 and a second seat surface operation shaft 53 respectively extend through the elongated holes 35 and 35*a*. The first seat surface operation shaft 52 and second seat surface operation shaft 53 cooperate together in forming a fourth operation portion.

The base ends of the two operation shafts 52 and 53 are connected to each other and, in the end face of the integrally connected base end, there is formed a fitting cylindrical portion 54. And, an operation body 37 is fitted into the fitting cylindrical portion 54. By the way, in the side walls of the two end portions of the fitting cylindrical portion 54, there are respectively formed slits 54*a* in such a manner that the slits 54*a* extend through their associated end portion side walls of the fitting cylindrical portion 54; and, a guide projecting portion 37*c*, which is projected from the operation body 37, is engaged into the slit 54*a* in such a manner that it can be freely slided in the same direction as the axial direction of the operation shaft 52. In the operation body 37, there are provided a pair of projections 37*a* and 37*b* in such a manner that they respectively correspond to the two movable contacts 16*a*3 and 16*b*3 of the opening and closing portions 16A and 16B (see FIG. 10). And, the operation body 37 is always pressed against the movable contacts 16*a*3 and 16*b*3 of the opening and closing portions 16A and 16B through a coiled spring 38 which is stored within the central portion of the operation body 37 and extends between the operation body 37 and fitting cylindrical portion 54. The positions of the movable contacts 16*a*3 and 16*b*3 are set such that, in a state where the two operation shafts 52 and 53 are not in operation, due to such pressing of the operation body 37 by the coiled spring 38, the movable contact 16*a*3 is contacted with the fixed contact 16*a*2 and movable contact 16*b*3 is contacted with the fixed contact 16*b*1.

In the first embodiment, 16 is used as a reference character to designate the vertical switch portion of the seat front portion seat surface. However, in the second embodiment, 16 is used to designate a seat surface vertical switch portion. Thus, in the second embodiment, the seat surface vertical switch portion 16 forms a first seat vertical switch.

Next, description will be given below of the seat switch knob 54.

Figure 12:
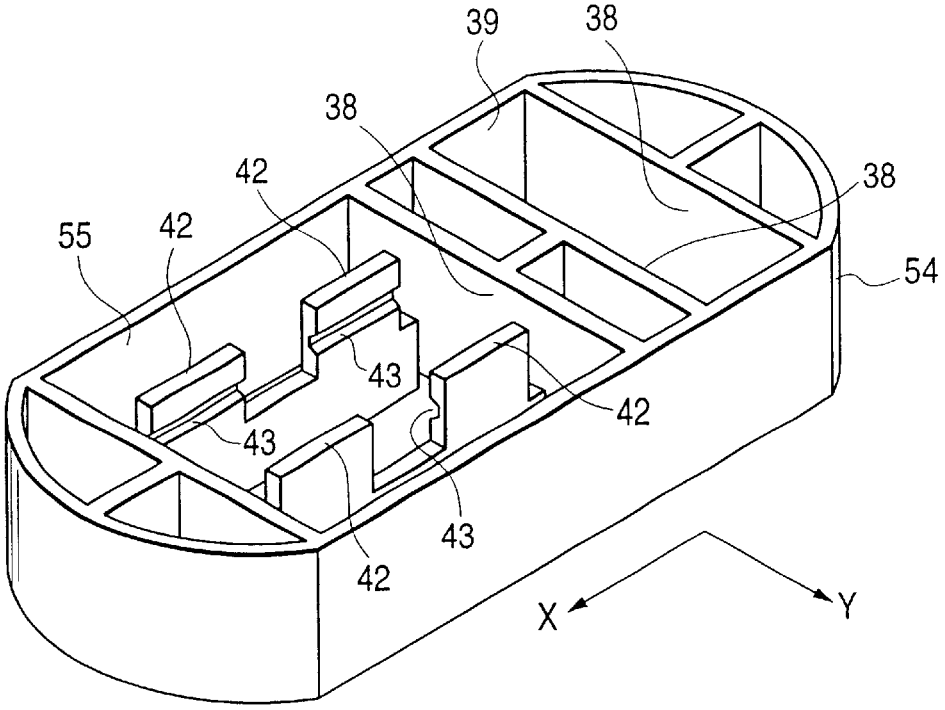
FIG. 12 is a perspective view of a seat switch knob employed in the second embodiment.

The seat switch knob 54, as shown in FIG. 12, comprises a slide operation shaft engaging chamber 39, which is formed in the anti-X-direction side end portion of the bottom surface of the seat switch knob 54 and is defined by partition walls 38, and a seat surface operation shaft engaging chamber 55 which is formed in the central and X-direction side end portion of the bottom surface of the seat switch knob 54 and is defined by partition walls 38. The slide operation shaft engaging chamber 39 has a rectangular-shaped section such that it extends in the Y direction, and the seat slide operation shaft 22 is fitted into the slide operation shaft engaging chamber 39 in such a manner that it can be moved in the Y and anti-Y directions as well as can be rotated in a reciprocating manner. In the present embodiment, the partition walls of the slide operation shaft engaging chamber 39 form a fifth engaging portion.

Figure 13:
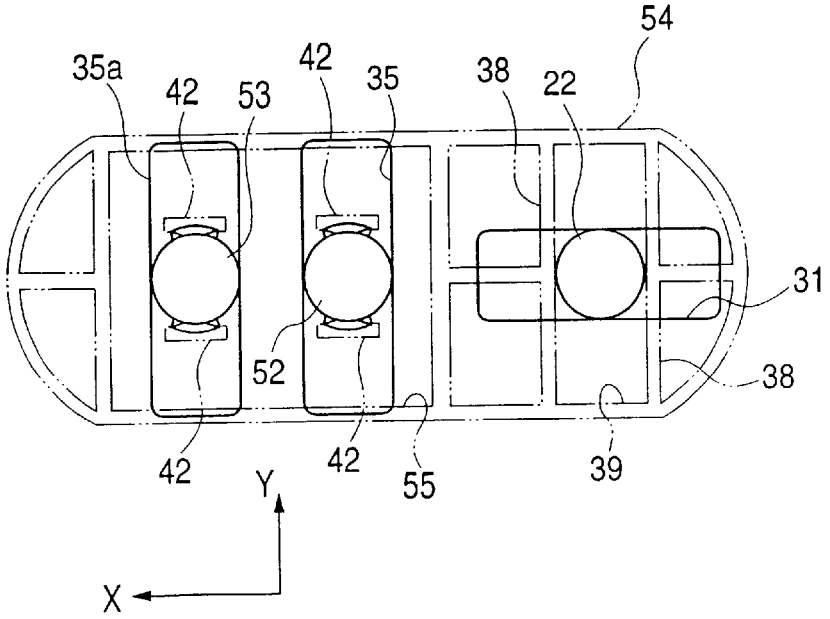
FIG. 13 is an explanatory view of the mutual relations between the respective operation shafts and the sat switch knob in the second embodiment.
Figure 14:
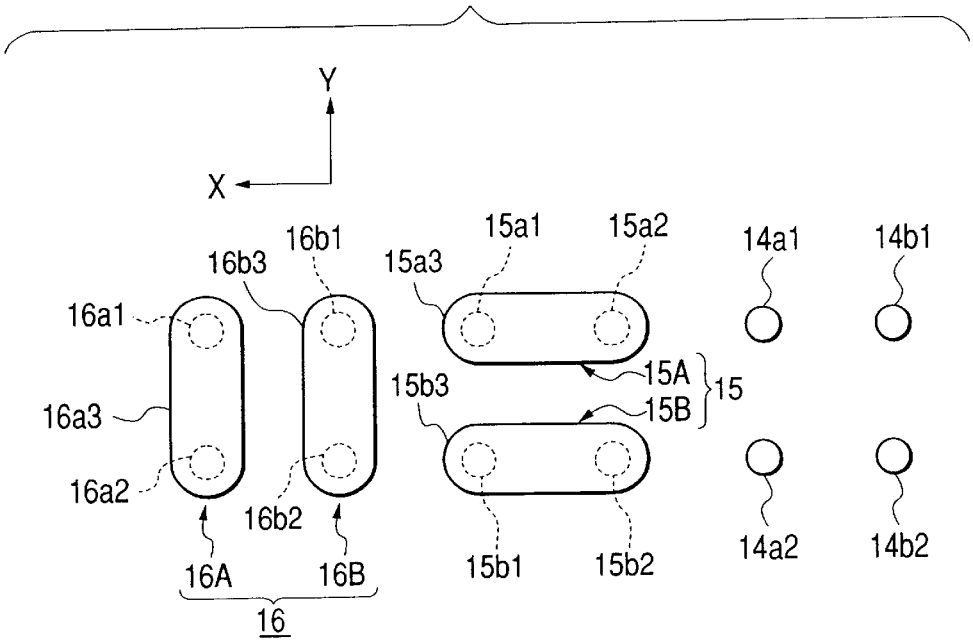
FIG. 14 is an explanatory view of the position relations between the respective switch portions of the second embodiment.

Also, on the seat surface operation shaft engaging chamber 55, there are provided two sets of hold pieces 42 which respectively project from the inner top surface of the seat surface operation shaft engaging chamber 55; and, one set of hold pieces 42 consists of a pair of hold pieces 42 which are spaced from each other in the Y direction. In the respective leading ends of the mutually opposing hold pieces 42, there are formed fitting grooves 43 which extend in the width directions (X, anti-X directions) of the respective hold pieces 42. And, as shown in FIG. 13, the respective ends of the first seat surface operation shaft 52 and second seat surface operation shaft 53 are held by the mutually opposing hold pieces 42 of the respective sets in such a manner that the first seat surface operation shaft 52 and second seat surface operation shaft 53 can be moved in the X and anti-X directions relatively to the hold pieces 42. The hold pieces 42 form a fourth engaging portion.

Also, as shown in FIG. 13, the length of the seat surface operation shaft engaging chamber 55 in the X direction is set as a length that allows the relative movements of the first seat surface operation shaft 52 and second seat surface operation shaft 53 in the X and anti-X directions with respect to the hold pieces 42. That is, due to the fact that, when the seat switch knob 54 is operated in the X or anti-X direction, the movements of the first seat surface operation shaft 52 and second seat surface operation shaft 53 in the same direction, that is, in the X or anti-X direction are restricted by the elongated holes 35 and 35*a*, the relative movements between the seat switch knob 54 and the first seat surface operation shaft 52 and second seat surface operation shaft 53 are permitted so that the seat slide operation shaft 22 can be moved smoothly in the X direction.

Also, when the seat switch knob 54 is operated in the Y or anti-Y direction while holding the central portion thereof, the movement of the seat slide operation shaft 22 in the Y or anti-Y direction is restricted by the elongated hole 31, while the first seat surface operation shaft 52 and second seat surface operation shaft 53 are operated or pressed by the seat switch knob 54 so that they are moved in such operation direction.

In the cover 19, as shown in FIG. 1, in correspondence to the reclining operation shaft 20, first seat surface operation shaft 52 and second seat surface operation shaft 53, there are formed through holes 56 and 57 (in the drawings, however, there are shown only the through holes that are formed in the first seat surface operation shaft 52 and second seat surface operation shaft 53).

Now, description will be given below of the operation of the above-structured unit U1.

Figure 15A:
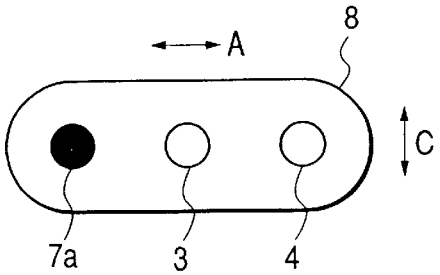
FIG. 15 (*a*) is an explanatory view of the operation directions of a conventional operation knob, and FIG. 15 (*b*) is an explanatory view of the movement of the seat surface of a power seat; and, FIG. 16 (*a*) is an explanatory view of the operation directions of a further conventional operation knob, FIG. 16 (*b*) is an explanatory view of the operation directions of a still further conventional operation knob, and FIG. 16 (*c*) is an explanatory view of the movement of the seat surface of a power seat.
Figure 15B:
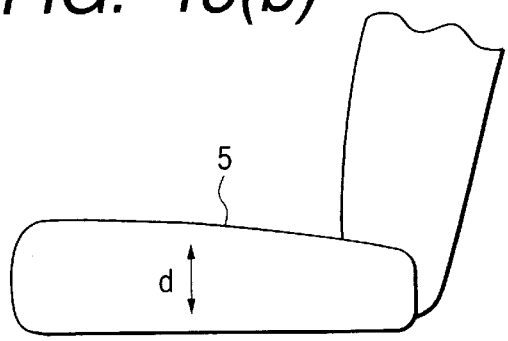
Figure 16A:
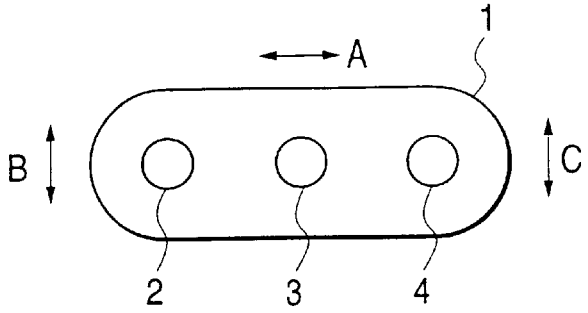
Figure 16B:
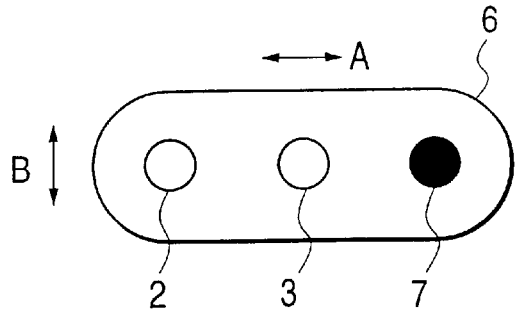
Figure 16C:
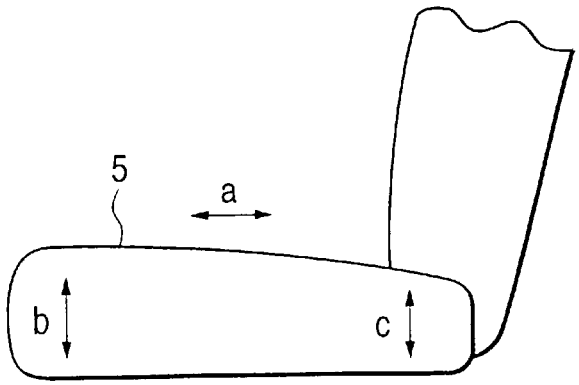

When the present unit U1 is assembled to the power seat of the vehicle, the switch portions 15 and 16 thereof, as shown in FIG. 7, are respectively connected to the battery power source B, seat sliding motor M3 and seat surface driving motor M5. That is, the fixed contacts a1 and a2 of the opening and closing portions A of the switch portions 15 and 16 are respectively connected to the battery power source B and grounding conductor, while the fixed contacts b2 and b1 of the opening and closing portions B of the switch portions 15 and 16 are respectively connected to the battery power source B and grounding conductor. By the way, the seat surface driving motor M5 is a drive motor which, as shown in FIG. 15, is used to move up or down the whole seat surface of the power seat.

And, when the seat switch knob 24 is not in operation, the projections 33*a*, 33*b* and 37*a*, 37*b* of the operation bodies 33 and 37 are guided to the respective two inclined surfaces of the V-shaped movable contacts a3 of the opening and closing portions A and B due to the energizing forces of the coil springs 34 and 38, so that the projections 33*a*, 33*b* and 37*a*, 37*b* are respectively pressed against the respective central portions of the movable contacts a3.

And, since the positions of the movable contacts a3 and b3 of the switch portion 15 and 16 are set such that the movable contacts a3 are respectively contacted with their associated fixed contacts a2 and the movable contacts b3 are respectively contacted with their associated fixed contacts b1, the unit U1 is held at its off position.

Therefore, in this state, the power seat is held in its stationary condition.

(Seat Sliding Operation)

When the operator wants to slide the power seat, for example, in the X direction, if the seat switch knob 54 is operated in the X direction against the energizing force of the coiled spring 34, then the seat slide operation shaft 22 is driven by the seat switch knob 54 and is thereby moved in the X direction. In response to this, the operation shafts 52 and 53 are restricted by the elongated holes 35 and 35*a* and are thereby moved relatively to the seat switch knob 54.

As a result of this, the projection 33*a* of the operation body 33 is moved while it is pressed against one (X-direction side) inclined surface of the V shape of the movable contact 15*a*3 of the opening and closing portion 15A. Due to this, the movable contact 15*a*3, in particular, the X-direction side contact end thereof is contacted with the fixed contact 15*a*1 (in FIG. 8, a1). Therefore, as shown in FIG. 8, the seat sliding motor M3 to be connected to the present switch portion 15 is driven or rotated forwardly and, due to the forward rotation of the motor M3, the power seat is moved forward in the X direction.

On the other hand, if the seat switch knob 54 is operated in the anti-X direction against the energizing force of the coil spring 34, then the projection 33*b* of the operation body 33 is pressed against one (anti-X-direction side) inclined surface of the V shape of the movable contact 15*b*3 of the opening and closing portion 15B to thereby move the present inclined surface. Due to the movement of projection 33*b*, the movable contact 15*b*3, in particular, the anti-X-direction side contact end thereof is contacted with the fixed contact 15*b*2 (in FIG. 9, b2). Therefore, as shown in FIG. 9, the seat sliding motor M3 to be connected to the present switch portion 15 is driven or rotated reversely and, due to the reverse rotation of the motor M3, the power seat is moved backward in the anti-X direction.

(Operation of Seat Surface of Power Seat)

When the operator wants to move up the power seat, for example, in the Y direction, if the seat switch knob 54 is operated in the Y direction against the energizing force of the coil spring 38, then the seat surface operation shafts 52 and 53 are driven by the seat switch knob 54 and are thereby moved in the Y direction. In response to the movements of the seat surface operation shafts 52 and 53, the operation shaft 22 is restricted by the elongated hole 31 and is thereby moved in the longitudinal direction (anti-Y direction) of the elongated hole 31 with respect to the seat switch knob 54.

As the result of the movements of the first and second seat surface operation shafts 52 and 53 in the Y direction, the projection 37*a* of the operation body 37 is pressed against one (Y-direction side) inclined surface of the V shape of the movable contact 16*a*3 of the opening and closing portion 16A to thereby move the present inclined surface. Due to this, the movable contact 16*a*3, in particular, the Y-direction side contact end thereof is contacted with the fixed contact 16*a*1 (in FIG. 8, a1). Therefore, as shown in FIG. 8, the seat surface driving motor M5 to be connected to the present switch portion 16 is driven or rotated forwardly and, due to the forward rotation of the motor M5, the whole seat surface of the power seat is moved up in the Y direction.

On the other hand, in the off state shown in FIG. 7, if the central portion of the seat switch knob 54 is operated in the anti-Y direction against the energizing force of the coil spring 38, then the operation shafts 52 and 53 are driven by the seat switch knob 54 and are thereby moved in the anti-Y direction. In response to the movements of the operation shafts 52 and 53, the operation shaft 22 is restricted by the elongated hole 31 and is thereby moved in the longitudinal direction (in the Y direction) of the elongated hole 31 with respect to the seat switch knob 54.

As the result of the movements of the first and second seat surface operation shafts 52 and 53 in the anti-Y direction, the projection 37*b* of the operation body 37 is pressed against one (anti-Y-direction side) inclined surface of the V shape of the movable contact 16*b*3 of the opening and closing portion 16B to thereby move the present inclined surface. Due to this, the movable contact 16*b*3, in particular, the Y-direction-side contact end thereof is contacted with the fixed contact 16*b*2 (in FIG. 9, b2). Thus, as shown in FIG. 9, the seat surface driving motor M5 to be connected to the present switch portion 16 is driven or rotated reversely and, due to the reverse rotation of the motor M5, the power seat is moved down in the anti-Y direction.

Next, description will be given below of the effects of the above-structured unit U1.

(1) In the present embodiment, when the operator wants to move up the seat surface of the power seat in the Y direction or move down the same in the anti-Y direction, if the central portion of the seat switch knob 54 is operated in the Y direction or in the anti-Y direction, then the seat switch knob 54 can be moved in the Y direction or in the anti-Y direction. And, the seat surface of the power seat can be moved up or moved down in correspondence to the operation direction of the seat switch knob 54.

(2) Also, in the present embodiment, when the operator wants to slide the power seat in the X direction (in the forward direction) or in the anti-X direction (in the backward direction), if the seat switch knob 54 is operated in the X direction or in the anti-X direction, then the seat switch knob 54 can be moved in the same direction. And, the power seat can be moved in the same direction as the operation direction of the seat switch knob 54.

(3) Further, the unit U1 and unit U are able to use in common the case main body 11, substrate 12, seat slide operation shaft 22, operation body 33, operation body 37, coil springs 34 and 38, movable contacts 15*a*3, 15*b*3, 16*a*3, 16*b*3 and the like. That is, common use of the parts between the units U and U1 makes it possible to reduce the cost of the present seat switch.

(4) Still further, in the present embodiment, there are disposed the first and second seat surface operation shafts 52 and 53, and the respective base ends thereof are connected to each other as an integral body. Thus, the two operation shafts 52 and 53 can be engaged with the central portion and X-side end portion of the seat switch knob 54, so that the operations of the seat switch knob 54 in the Y and anti-Y direction can be executed in a stable manner.

The embodiments of the invention are not limited to the illustrated first and second embodiments but the invention can also be enforced by changing the first and second embodiments in the following manner:

(1) In the first embodiment, in the restriction plate 18, there are formed the elongated holes 28, 31 and 35. However, according to the invention, there can also be formed an elongated hole 35*a* at a position shown by a two-dot chained line in FIG. 2. Such formation of the elongated hole 35*a* makes it possible to use the restriction plate 18 of the first embodiment as the restriction plate 18 of the second embodiment, which in turn can realize common use of the parts.

(2) On the other hand, in the second embodiment, in the restriction plate 18, there are formed the elongated holes 31, 35 and 35*a*. However, according to the invention, there can also be formed an elongated hole 28 at a position shown by a two-dot chained line in FIG. 11. Such formation of the elongated hole 28 makes it possible to use the restriction plate 18 of the second embodiment as the restriction plate 18 of the first embodiment, which in turn can realize common use of the parts.

(3) And, in the first embodiment, at the portion of the restriction plate 18 that corresponds to the elongated hole 35*a*, there can also be previously formed a thin portion which defines an elongated hole in such a manner that the thin portion can be hit through, and, when the present restriction plate 18 is used in the unit U1 according to the second embodiment, by hitting the present thick portion through, the elongated hole 35*a* can be made. In this case as well, the parts of the present seat switch can be used in common.

(4) Also, in the second embodiment, at the portion of the restriction plate 18 that corresponds to the elongated hole 28, there can also be previously formed a thin portion which defines an elongated hole in such a manner that the thin portion can be hit through, and, when the present restriction plate 18 is used in the unit U according to the first embodiment, by hitting the present thick portion through, the elongated hole 28 can be made. In this case as well, the parts of the present seat switch can be used in common.

Next, description will be given below of other technical ideas that can be understood from the embodiments illustrated hereinbefore, as well as the effects thereof.

(1) A seat switch in which the restriction member includes a restriction portion which, when the first and third operation members are operated in a first operation direction, permits the movements of the first and third operation members in the first operation direction and, when the second operation member is operated in a second operation direction, prevents the first and third operation members from moving in the second operation direction. With employment of this structure, the restrict portion permits the movements of the first and third operation members in the first operation direction and also prevents the movements of the first and third operation members in the second operation direction. In this case, in the first embodiment, the elongated holes 28 and 35 correspond to the restriction portion.

(2) A seat switch in which the restriction member includes a restrict portion which, when the fourth operation members is operated in a first operation direction, permits the movement of the fourth operation member in the first operation direction and, when the second operation member is operated in a second operation direction, prevents the fourth operation member from moving in the second operation direction. With employment of this structure, the restriction portion permits the movement of the fourth operation member in the first operation direction and also prevents the movement of the fourth operation member in the second operation direction. With use of this structure, in the second embodiment, the elongated holes 35 and 35*a* correspond to the restriction portion.

Since the present seat switch is structured such that it can be used not only in a power seat of a seat vertical 4-way type but also in a power seat of a seat vertical 2-way type in which the whole seat surface of the power seat can be moved in the vertical direction, the switch parts thereof can be used in common and thus the cost of the present seat switch can be reduced. In addition to this excellent effect, the present seat switch can provide another excellent effect that the operation direction thereof can be adjusted to the movements of the two types of power seats.

What is claimed is:

1. A seat switch for adjusting a power seat comprising:

a case main body including a first switch, a seat slide switch and a second switch arranged within said case main body;

a first operational member movably attached to said case main body, wherein said first operational member selectively engages said first switch when operated in a first direction;

a second operational member movably attached to said case main body, wherein said second operational member selectively engages said seat slide switch when operated in a second direction, which is substantially perpendicular to said first direction;

a third operational member movably attached to said case main body, wherein said third operational member selectively engages said second switch when operated in said first direction;

a restriction member disposed in said case main body, wherein said restriction member restricts movement of said second operational member when said first and third operational members are operated in said first direction, and restricts movement of said first and third operational member when said second operational member is operated in said second direction; and a knob member including first and third engaging portions selectively engaging said first and third operational members, respectively, and a second engaging portion selectively engaging said second operational member; wherein said first and third engaging portions engage said first and third operational members, and said second engaging portion freely slides over said second operational member, when operated in said first direction; and said second engaging portion engages said second operational member, and said first and third engaging portions freely slide over said first and third operational members, when operated in said second direction.

2. The seat switch according to claim 1, wherein at least one of said operational members includes a shaft, an engagement end, and a cylindrical portion disposed between said shaft and said engagement end, wherein said engagement end is offset from the center line of said shaft.

3. The seat switch according to claim 2, further including a guide portion disposed in said case main body around at least one of said first and second switch for guiding said engagement end.

4. The seat switch according to claim 1, wherein said knob member further includes attachment tabs to connect said knob member to at least one of said operational members.

5. The seat switch according to claim 4, wherein said attachment tabs each include a groove, and at least one of said operational members include a shaft having cylindrical projection, wherein said cylindrical projection engages said groove.

6. The seat switch according to claim 5, wherein said cylindrical projection is attached to said first and third operational members.

7. The seat switch according to claim 4, wherein said attachment tabs are elastic members.

8. The seat switch according to claim 1, further including a support member connected to at least one of said operational members by a spring, wherein said support member is biased against said knob member.

9. The seat switch according to claim 8, wherein said support member is connected to said second operational member.

10. The seat switch according to claim 1, wherein said second operational member is positioned between said first and third operational member.

11. The seat switch according to claim 1, wherein said first operational member is positioned between said second and third operational member.

12. The seat switch according to claim 1, wherein said third operational member is positioned between said first and second operational member.

13. The seat switch according to claim 1, wherein said restriction member includes a plurality of elongate holes, wherein each of said elongate holes are positioned around each of said operational members, respectively.

14. The seat switch according to claim 13, wherein said restriction member includes a perforated portion defining an additional elongate hole and arranged substantially parallel to one of said elongate holes.

15. The seat switch according to claim 13, wherein said restriction member includes an additional elongate hole and arranged substantially parallel to one of said elongate holes.

16. A seat switch for adjusting a power seat comprising:

a case body including a positioning switch and a slide switch arranged within said case body;

a positioning member movably connected to said case body, wherein said positioning member comprises a plurality of actuating rods, a cylindrical fitting connecting said actuating rods together, and engaging contact attached to said cylindrical fitting opposite said actuating rods, and wherein said positioning member selectively engages said positioning switch when operated in a first direction;

a displacement member including a shaft movably connected to said case body, wherein said displacement member selectively engages said slide switch when operated in a second direction, which is substantially perpendicular to said first direction;

a restriction plate disposed in said case body, wherein said restriction plate restricts movement of said displacement member when said positioning member is operated in said first direction, and restricts movement of said positioning member when said displacement member is operated in said second direction; and an adjustment knob having a plurality of slots, wherein said slots are arranged to engage said positioning member and allow said displacement member to move freely, when operated in said first direction, and when operated in said second direction, said slots engage said displacement member and allow said positioning member to move freely.

17. The seat switch according to claim 16, further including a guide disposed at the end of said engaging contact.

18. The seat switch according to claim 16, wherein said adjustment knob further includes attachment tabs each having a groove, and said actuating rods further include a projection, wherein each projection engages said groove corresponding to said projection.

19. The seat switch according to claim 16, wherein said restriction plate includes a plurality of elongate holes, wherein said elongate holes are positioned around said actuating rods and said shaft.

20. The seat switch according to claim 19, wherein said restriction plate includes an additional elongate hole and arranged substantially parallel to one of said elongate holes.

* * * * *